United States Patent [19]

Sero et al.

[11] Patent Number: 4,974,997

[45] Date of Patent: Dec. 4, 1990

[54] HYDRAULIC SETTING TOOL FOR INSTALLING ANCHORING AND FOUNDATION SUPPORT APPARATUS

[75] Inventors: Samuel J. Sero, Pittsburgh; James S. Collins, Monaca; Victor Yates, Sewickley, all of Pa.

[73] Assignee: Secure Anchoring & Foundation Equipment, Inc., Aliquippa, Pa.

[21] Appl. No.: 169,019

[22] Filed: Mar. 16, 1988

Related U.S. Application Data

[63] Continuation-in-part of Ser. No. 878,859, Jun. 26, 1986, abandoned, which is a continuation-in-part of Ser. No. 647,172, Sep. 4, 1984, abandoned.

[51] Int. Cl.[5] ..... E02D 5/54; E02D 5/80; E02D 7/00

[52] U.S. Cl. ..... 405/231; 405/232; 405/258; 405/271; 52/115; 52/155

[58] Field of Search ..... 405/229, 230, 231, 232, 405/244, 258, 271; 52/115, 118, 155, 156, 160–162, 165; 254/93 R, 228

[56] References Cited

U.S. PATENT DOCUMENTS

| | | | |
|---|---|---|---|
| 3,056,477 | 10/1962 | Wooley . | |
| 3,855,745 | 12/1974 | Patterson et al. | 405/244 X |
| 4,453,863 | 6/1984 | Sutton et al. | 405/282 |

FOREIGN PATENT DOCUMENTS

| | | | |
|---|---|---|---|
| 73722 | 6/1981 | Japan | 405/231 |
| 185826 | 10/1983 | Japan | 405/244 |
| 30713 | 2/1985 | Japan | 405/231 |
| 1033636 | 8/1983 | U.S.S.R. | 405/244 |
| 919768 | 2/1963 | United Kingdom | 254/228 |

*Primary Examiner*—Randolph A. Reese
*Assistant Examiner*—John A. Ricci
*Attorney, Agent, or Firm*—Webb, Burden, Ziesenheim & Webb

[57] ABSTRACT

A hydraulic setting tool assembly for setting earth anchor and foundation devices comprising side-by-side hydraulic motive members. Each motive members comprises a piston movable within a cylinder. The piston has a piston arm extending out of the cylinder. Movement of a piston under the pressure of hydraulic fluid causes the associated piston arm to extend from or retract into its associated cylinder. A piston arm bearing plate is secured to the extended ends of the piston arms. A cylinder bearing plate is secured to the base of the cylinders. The bearing plates are parallel to each other and an opening is provided in each of the plates midway between the motors so that said openings are aligned for the passage of a threaded rod therethrough. An adjustable nut on the rod restrains one of the bearing plates against movement along the rod while the other bearing plate can move relative to the rod to force an earth anchor or foundation device into the earth.

10 Claims, 15 Drawing Sheets

Fig. 8.
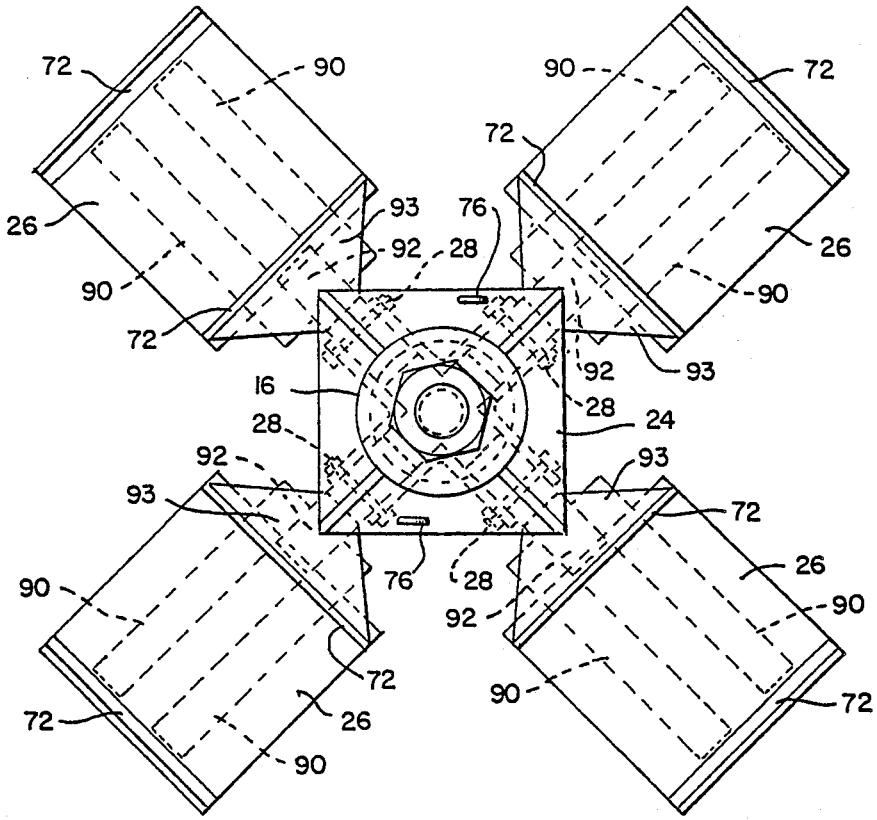
Fig. 6.
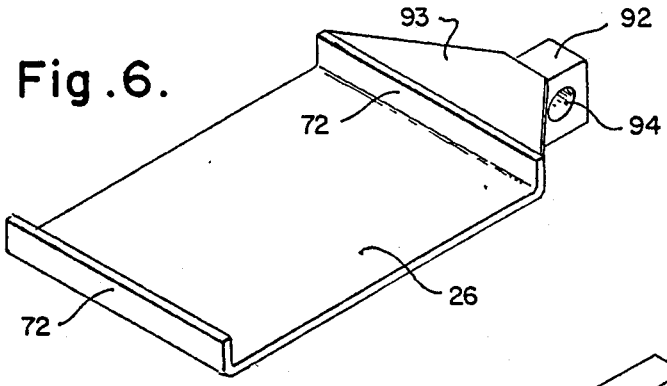
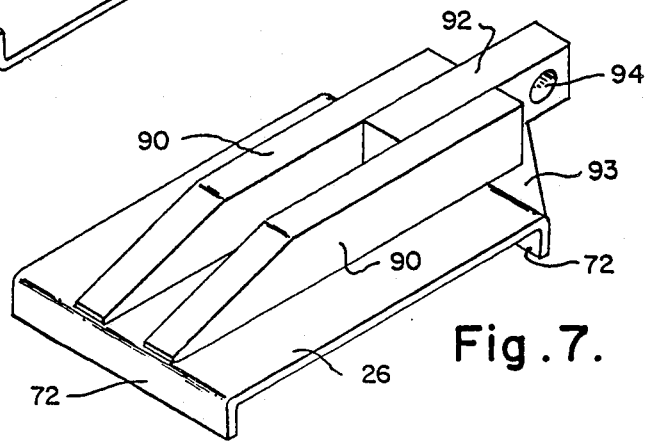
Fig. 7.

270
180
230
222
216
216
216
218
210
210
206
184

270
222
216
216
216
218
210
210

HYDRAULIC SETTING TOOL FOR INSTALLING ANCHORING AND FOUNDATION SUPPORT APPARATUS

This application is a continuation-in-part of Ser. No. 878,859, filed June 26, 1986, now abandoned, which was a continuation-in-part of Ser. No. 647,172, filed Sept. 4, 1984, now abandoned.

This invention relates to an hydraulic setting tool assembly. The assembly can be used for any application but is particularly useful for installing a structural anchor or foundation in an earthen hole.

The hydraulic setting tool assembly is particularly useful in applying the large force required in setting an anchor or foundation apparatus which strengthens media by utilizing shear strength, which is the strongest component of media strength. In operation,such an anchor or foundation apparatus acts to prestress a portion of the surrounding media, expand the load bearing zone of influence and develop a controlled and measurable shear plane out in the surrounding media.

The mechanisms of compaction and consolidation of any media to achieve greater strengths have been known but are more significantly utilized by this device. Likewise it has been significantly utilized by this device. Likewise it has been recognized that the shear strength of a media is its strongest and most measurable component but, until this device, the shear value of a media has been solely a topic of laboratory analysis.

The hydraulic setting tool is installed externally to the anchor or foundation device. It is preferred to employ the setting tool in combination with an anchor or foundation device, such as the preferred device described herein, which requires the application of extreme forces to the surrounding media to consolidate the surrounding media and increase the sheer strength. Upon application of these forces the first mechanism of operation to occur with the preferred anchor or foundation device is the compaction of the media to displace any moisture or air pockets. This has the effect of forcing the particles of the media into a direct and cohesive contact. Upon continued application of external force the particles are interlocked or consolidated into a denser media, synonymous with the formation of a sandstone from sand particles. Throughout the compaction and consolidation phases the device is developing a controlled shear plane out in the media away from the device. The mechanism of measuring the shear value, as employed in the laboratory, is duplicated in this field installation. It is therefore possible to make a direct gauge reading of a known quantity that is the actual developed strength of the media to resist anchor or foundation loading.

All of the presently used or known anchoring and foundation methods utilize only a frictional developed zone of influence, which is the lesser component of a media's strength, to resist loading. Because it is not only the lesser component but also the least capable of being measured with any degree of accuracy or reliability, present systems are conservatively overdesigned, labor and material intensive and/or economically unfeasible to manufacture and utilize in the sizes required to achieve any usable degree of strength.

Present anchor technology and use is predicated on the most economical way of placing a frictional anchor, dead man anchor, or object of equivalent load weight into the earth. Foundation design is based on placing a concrete mat below frost level with a surface area large enough to distribute the load into the earth below, or a frictional device such as a pile. None of these devices have a direct method of exactly determining its load resisting or bearing capacity. Without prior preparation of the media, they do not upon installation increase the media's load bearing capacity or consolidate the soil to eliminate settlement or creep, or prestress the installation above loading requirement, to assure the structure's capability of carrying required loading. All require random soil borings and laboratory testing to estimate the media's strength in its natural state. These data are then averaged to estimate overall site conditions. Structure design is then accomplished with safety factors attempting to compensate for the inconsistencies in the testing process and site conditions. Testing of a structure's strength cannot be accomplished without destroying its integrity. Due to economic pressure, site pre-investigation and media testing is reduced or eliminated and the structure's reliability becomes questionable. This creates unpredictable future costs in correcting structural damage due to failure, whether partial or full, and other created liabilities.

The preferred anchor or foundation device of this invention minimizes costs, eliminates the need of in-ground concrete, eliminates the need for costly deep drilling and media analysis, and estimates approximating the holding strength by providing an actual measurement of the structure's strength.

The hydraulic tool setting assembly of the invention is used to apply a smooth and continuous hydraulic force to the preferred anchor or foundation device to outwardly swing pivoted consolidating and shear control plates in a compacting and consolidating motion into the walls of a hole in any media. The hydraulic force that is required by the consolidating and shear plates to compact and consolidate the surrounding media provides a controlled shear plane in the media. After the anchor or foundation device is set, the hydraulic tool assembly is particularly useful for setting a turning moment resisting vane assembly around the anchor or foundation device.

Setting of the anchor or foundation device requires augering a hole in the media followed by lowering of the device into the hole so that the device rests at the bottom of the hole. Once the device is installed, the hydraulically actuated motive means of this invention forces the plates to swing outwardly in an arc to compact and consolidate the surrounding media. If a solid mass such as rock resists compacting and consolidation when employing large plates, the plates can be removed and smaller plates used, or plates with cutting edges may be used. With looser media, such as sand, large plates may be substituted. It should be understood that the term media as used herein includes all types of land composition, be it rock, clay, sand, soil or other and mixtures thereof. The device utilizes the compaction, consolidation and positioning of the shear plane to maximize the load bearing strength of the media at any given setting force. The hydraulic motive means can then be used to set a moment resisting vane assembly around the anchor or foundation device.

The combination of the hydraulic motive means and the preferred anchor or foundation device avoids the use of in ground concrete. It secures anchors and foundations and gives an actual reading of the set structures strength in restraint or bearing through direct gauge readings of the force applied to actuate the motive means.

The preferred anchor or foundation means comprises central rod means, compaction and consolidation plate assembly means with a central opening for concentrically mounting said plate assembly means about said central rod means, said compaction and consolidation plate assembly means having a plurality of circumferentially spaced outwardly swingable compaction and consolidation plates mounted thereon, spreader means adapted to swing said compression and consolidation plates outwardly into the surrounding media for an arc up to 45 or 55 degrees, limiting means adapted to limit said swing to an arc of 45 or 55 degrees, force applying means adapted to force said spreader means into swinging said plates into said surrounding media and compacting and consolidating and positioning the shear plane for any applied force in said media, restraining means for restraining said plate assembly means from vertical movement during said swing, and media containment means on said plates to cooperatively function with the surfaces of said plates facing the media to contain respective portions of said media.

In the preferred anchor or foundation device, the swingable plates are provided with media containment means. The media containment means can comprise peripheral rib-like members along the upper and lower edges of the plates. As the plates swing outwardly into the surrounding media, the media containment means cooperate with the plate surfaces facing the media to entrap or contain respective plug-like portions of the media on the plate surfaces which are urged into the media. When the surrounding media is earth and the plates swing outwardly over even a small arc, the compacted earth in the vicinity of the plates tends to consolidate and become rock-like. Increases in hydraulic force to increase the arc from above 0 up to 45 or 55 degrees enlarges the mass of earth which is consolidated into a rock-like material. The greater the mass of consolidated material which is formed, the greater the area of earth that must be sheared to dislodge the device. In addition, a rock-like plug or portion of consolidated earth is wedged onto the plate surface by the containment means and this plug eliminates frictional failure at the plate and resists shearing of the consolidated earth near the plate. Both of these shearing features require a greatly increased force to dislodge an apparatus of this invention having media containment means, as compared to a similar device without media containment means. The functioning of the described media containment means on the plate surface requires the large forces that can be exerted by the hydraulic setting too of this invention.

An unusual feature of an anchor or foundation device having media containment means on the compaction and consolidation plates is that when it is used to consolidate soil it provides a maximum shearing area, and therefore a maximum securing strength, when the plates are swung outwardly to an arc of no more than about 45 or 55 degrees. When the arc increases above 45 or 55 degrees, there is a reduction in the shearing area and therefore also a reduction in the securing strength. Therefore, the apparatus is provided with limiting means to limit the swing to 45 or 55 degrees. By way of contrast, a similar apparatus without media containment means in the same soil media reaches a maximum shearing area when the plates are swung outwardly over an arc of 90 degrees, but that shearing area is considerably less than the shearing area achieved at a 45 degree arc with the apparatus of this invention.

It is noted that when the anchor or foundation device is employed in a rock media, it will generally not be possible to swing the plates over as great an arc as when the surrounding media is soil. In general, a useful arc setting range in a rock media is about 5 to 15 degrees. In either case, an indirect indication of the arc through which the plates are swung in a subterranean location can be provided at the surface by measuring the vertical distance of movement of the rod carrying the spreader means used to swing the plates outwardly.

The use of gauge means to measure the hydraulic force used to swing the plates into the surrounding media is a useful feature of the invention. Such pressure gauge means will provide indications of any significant incremental increases in force requirements to swing the plates outwardly over progressive arc increments. Such increases in force will be indicative of enhanced consolidation of the soil media. Since the consolidation of earth is enhanced by the use of the media containment means, full advantage of the media containment means is indicated by gauge means.

The use of pressure gauge means at the hydraulic setting tool will be required when the anchor or foundation device is used to test the nature of the surrounding media at various depths in a particular hole. In such case, the device is expanded at various depths of the hole and the reading on the pressure gauge required to swing the plates over a given arc and into the surrounding media will be indicative of the nature of the media at the depth being tested. The device is provided with hook receiving means for collapsing the device after each test and moving it to a different location or out of the earthen hole. By this method, a proper media strata can be selected for good support.

The media containment means on the anchor or foundation device can be defined by one or more ribs on the periphery of the surface of the swinging plates. These ribs can be of any useful configuration. For example, when the surrounding media is earth the leading surface of the ribs can be blunt. When the surrounding media is rock, a leading edge can be employed. Because the ribs function cooperatively with the surface of the plates facing the media to contain the media upon spreading and continue to do so upon a force for dislodgement, said plate should not have a surface which tends to shed the media upon spreading.

The invention will be more fully understood by reference to the attached drawings in which.

Figure 1:
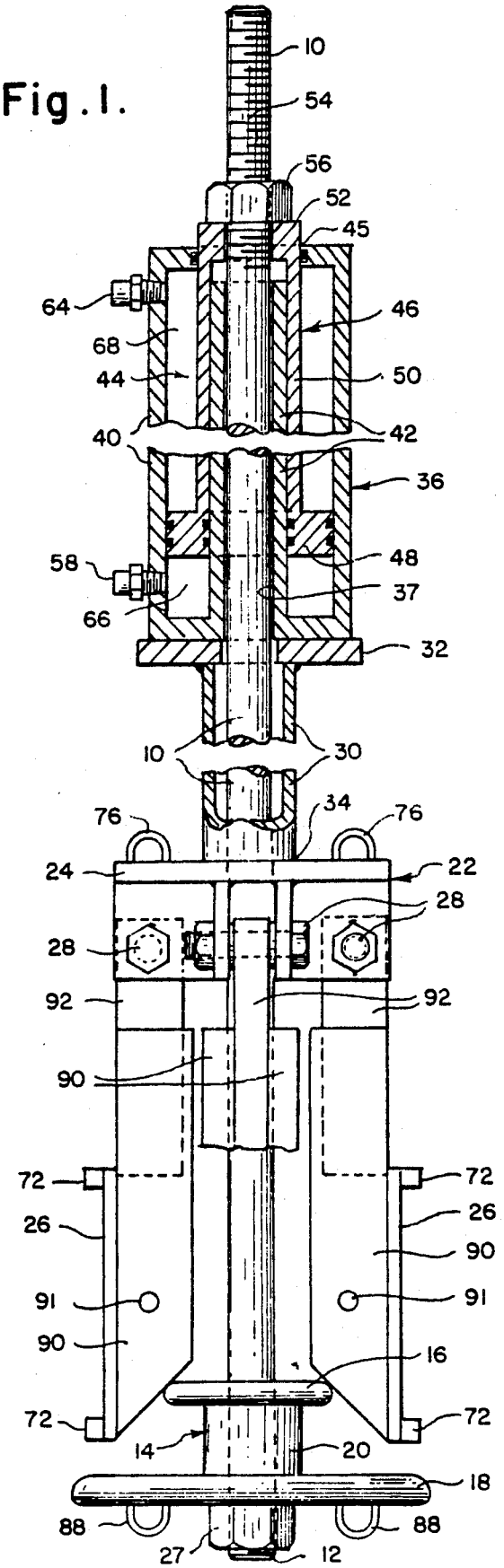
FIG. 1 illustrates a device assembled for the anchor mode, but prior to extension.
Figure 2:
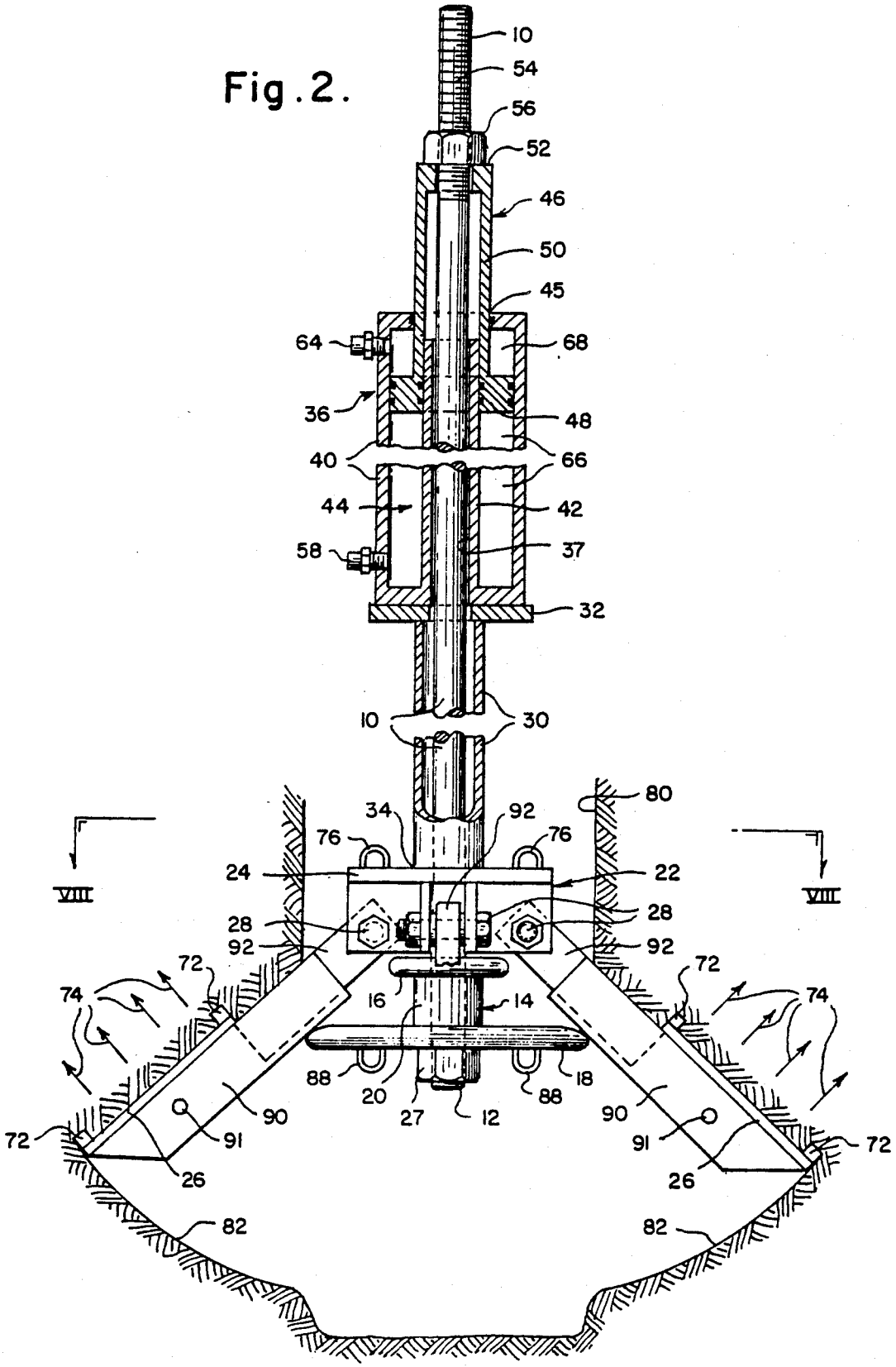
FIG. 2 illustrates a device extended for operation in the anchor mode.
Figure 3:
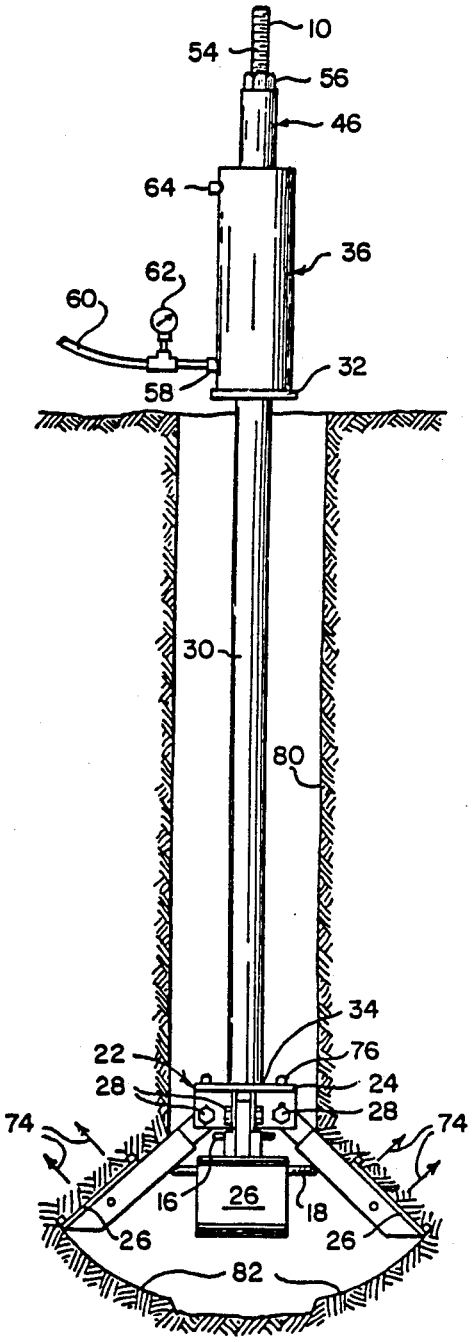
FIG. 3 illustrates a device extended for operation within the anchor mode and positioned in an earthen hole.
Figure 9:
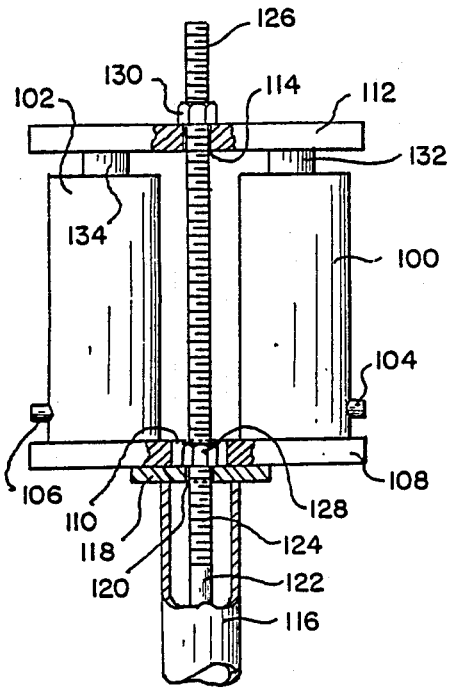
Figure 10:
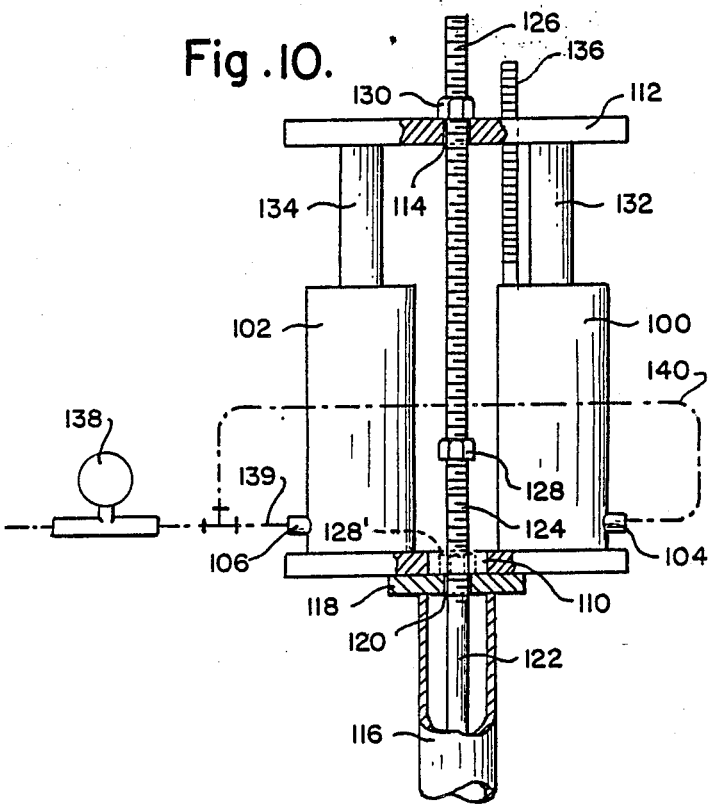
Figure 13:
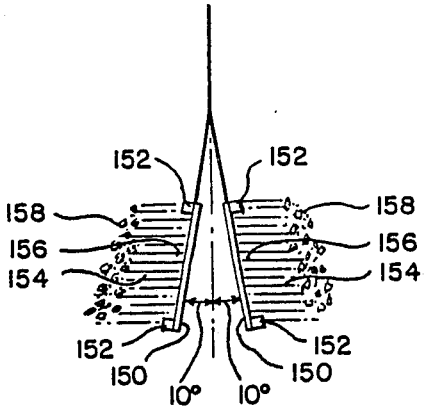
Figure 14:
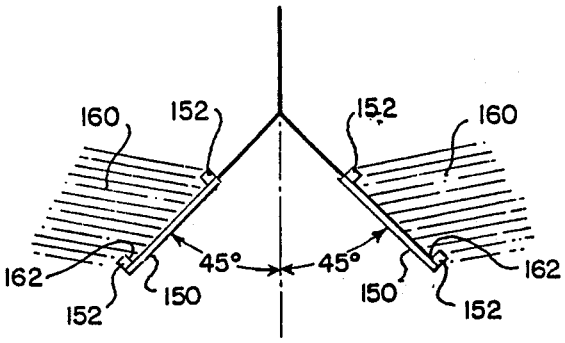
Figure 11:
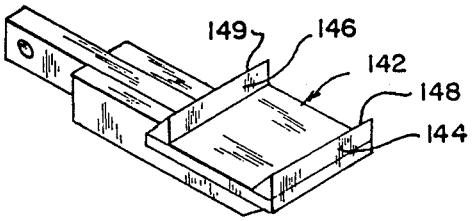
Figure 12:
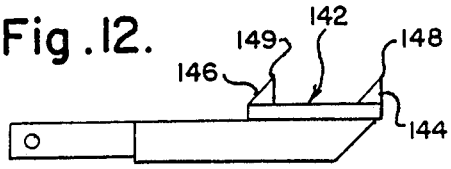
Figure 15:
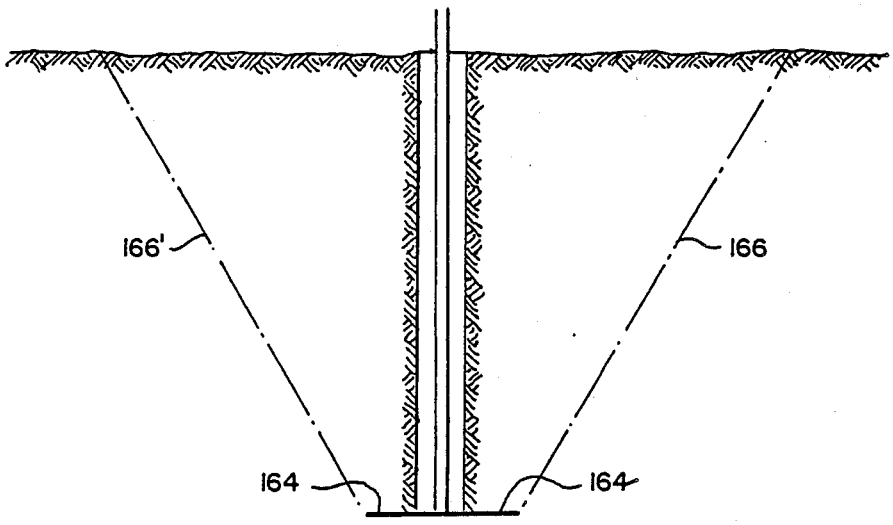
Figure 16:
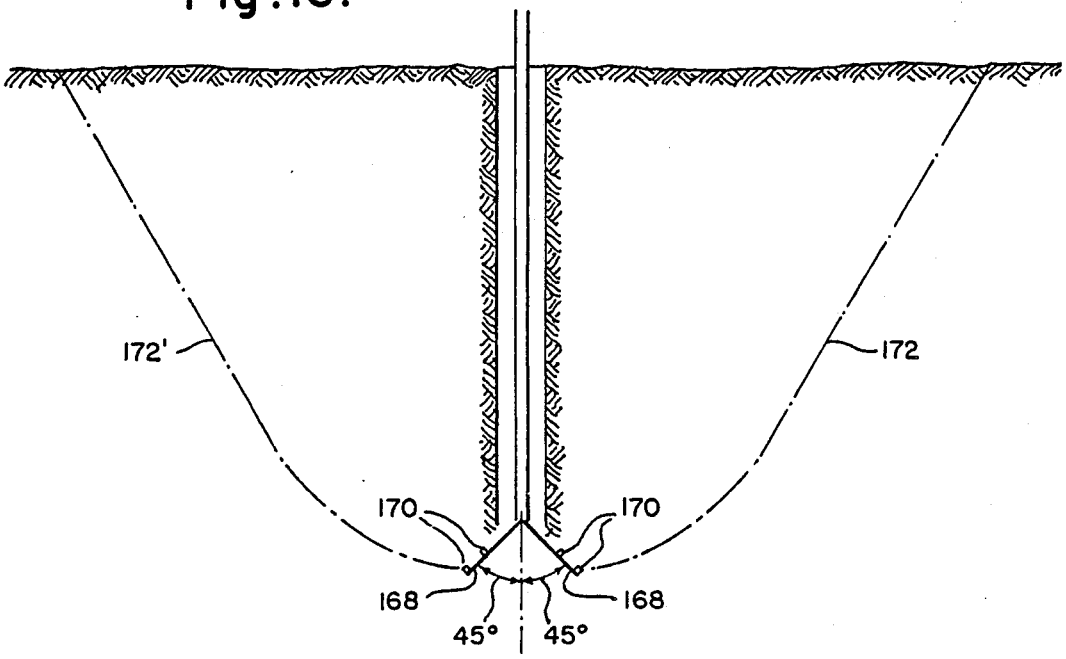
Figure 17:
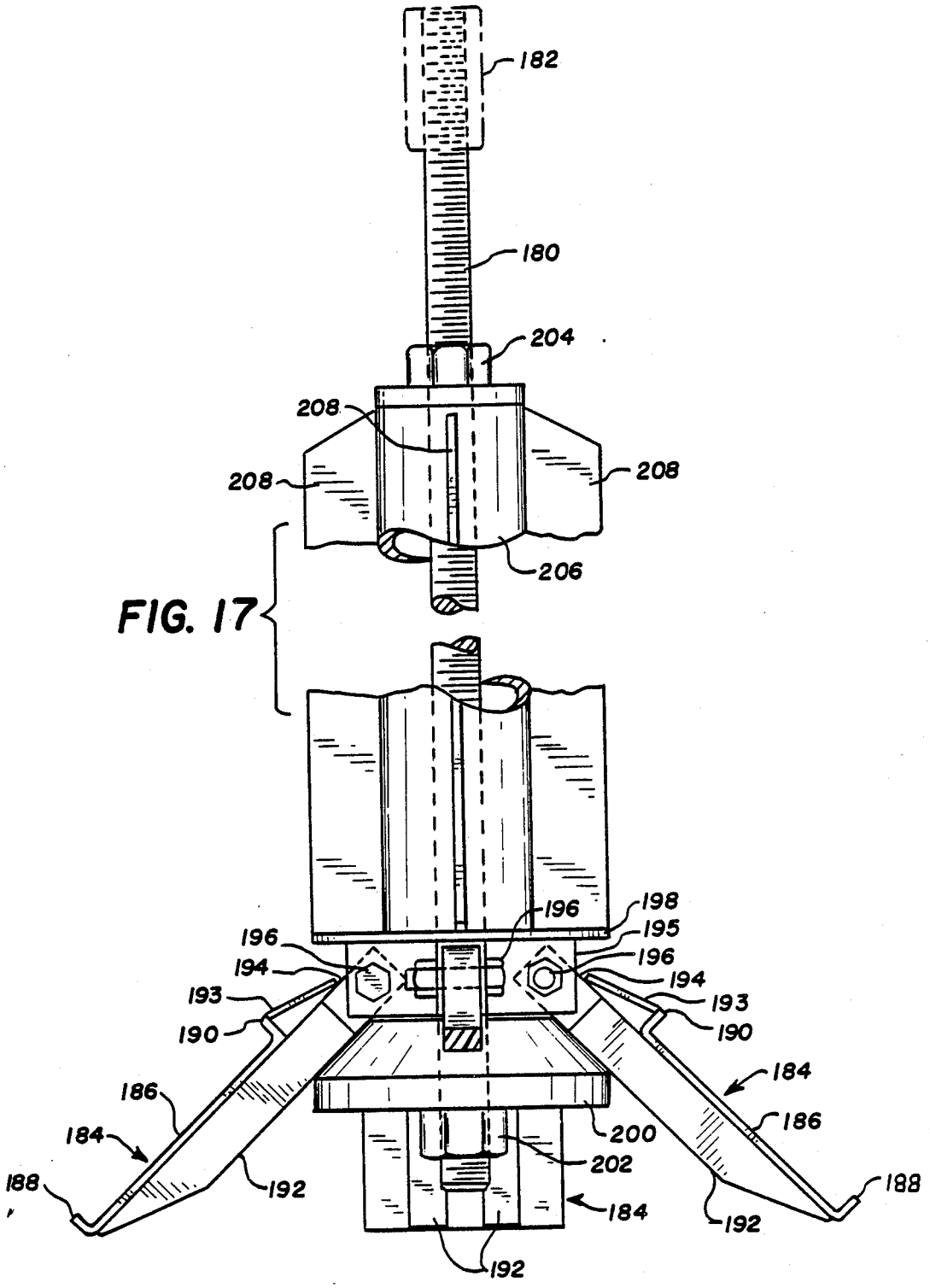
Figure 18:
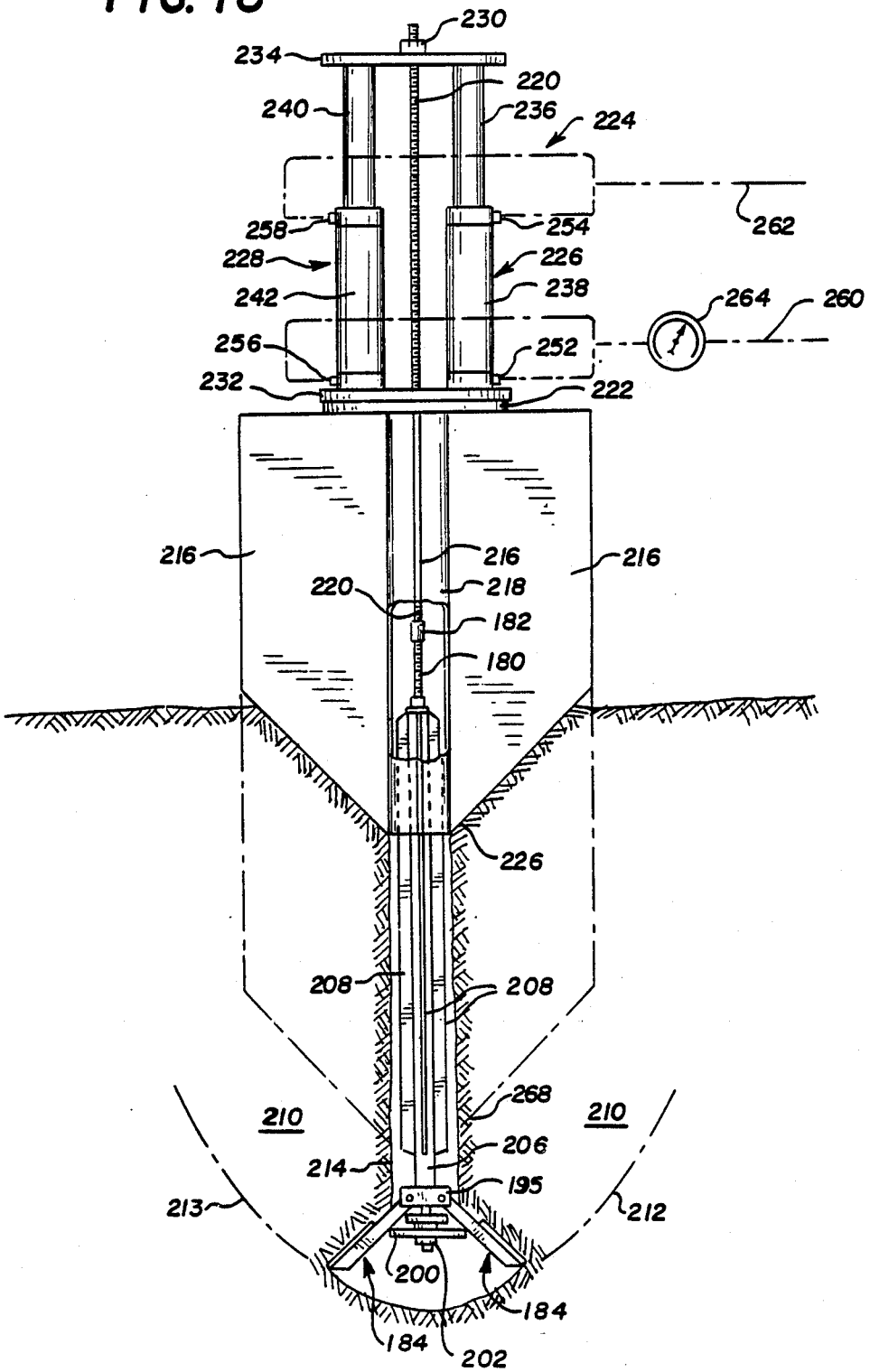
Figure 19:
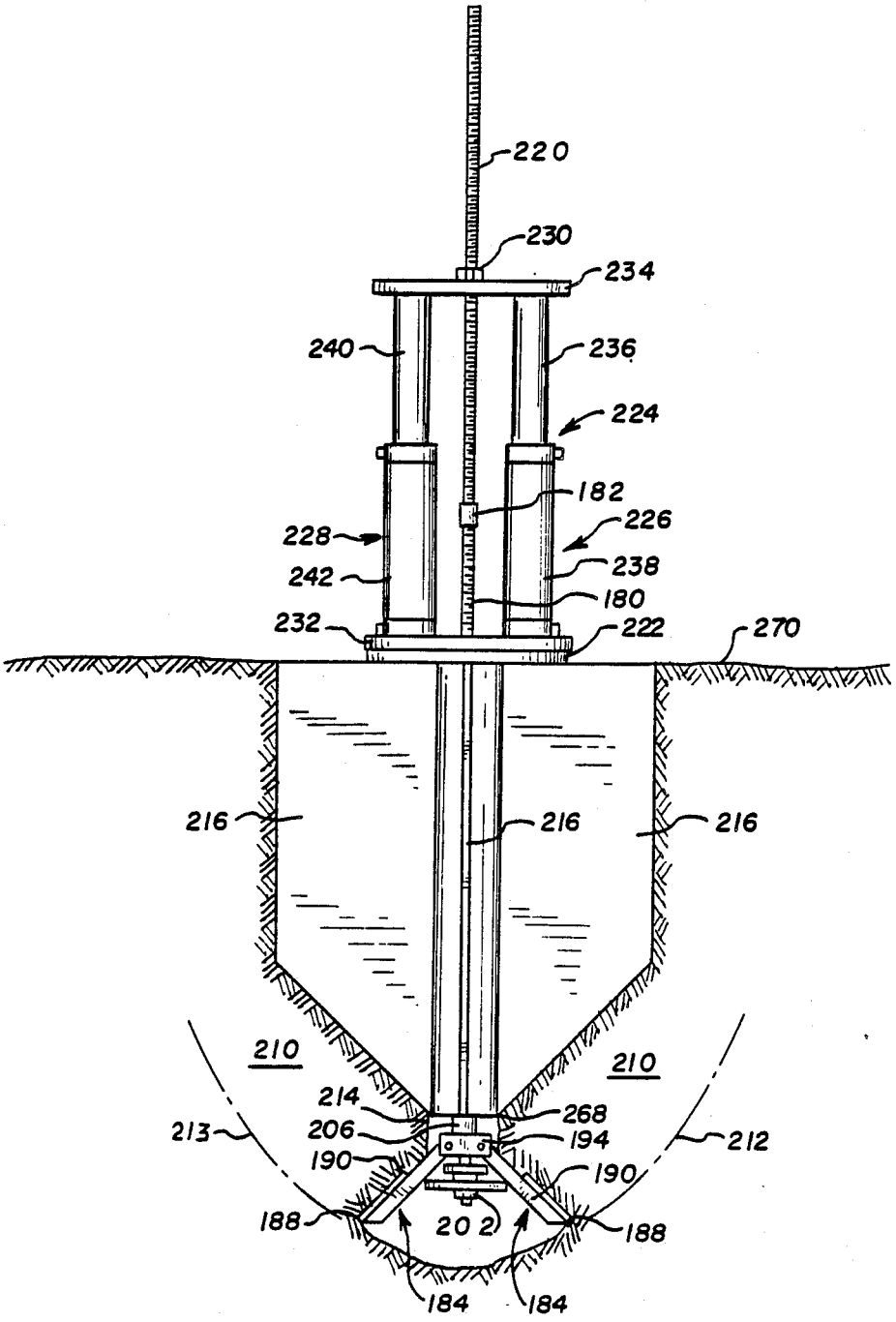
Figure 20:
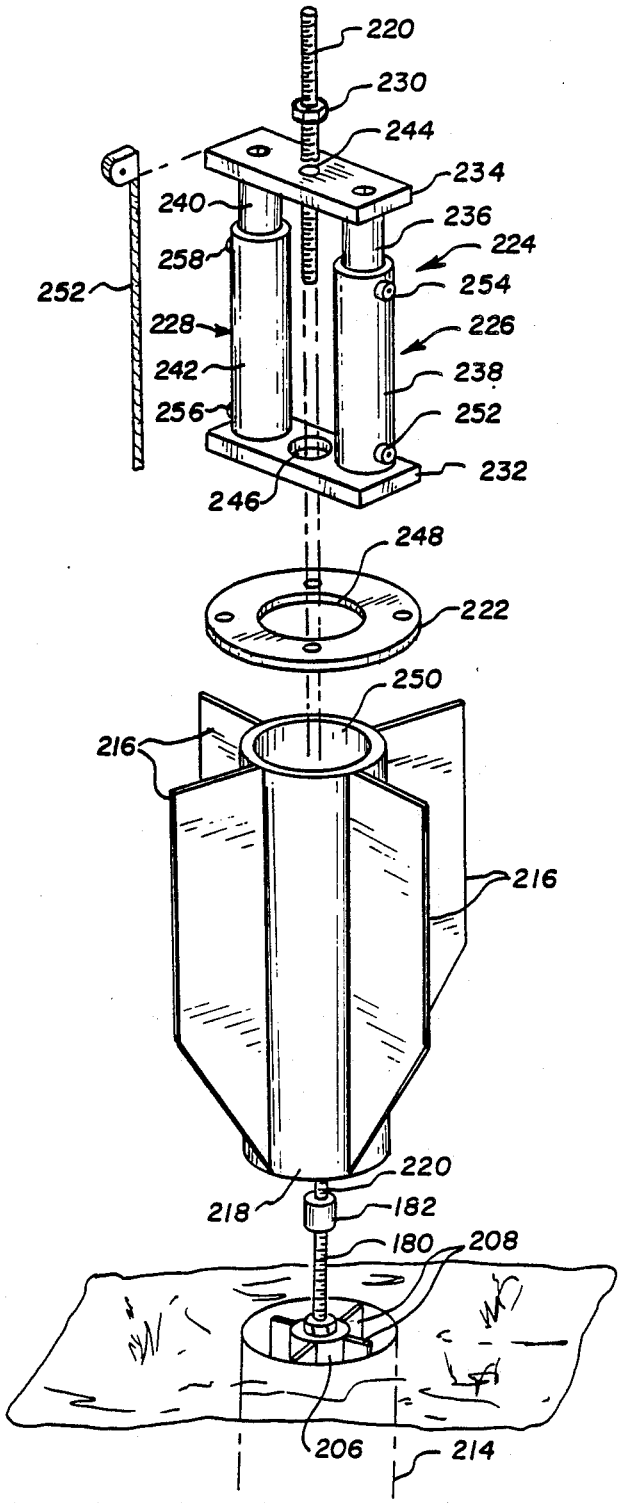
Figure 21:
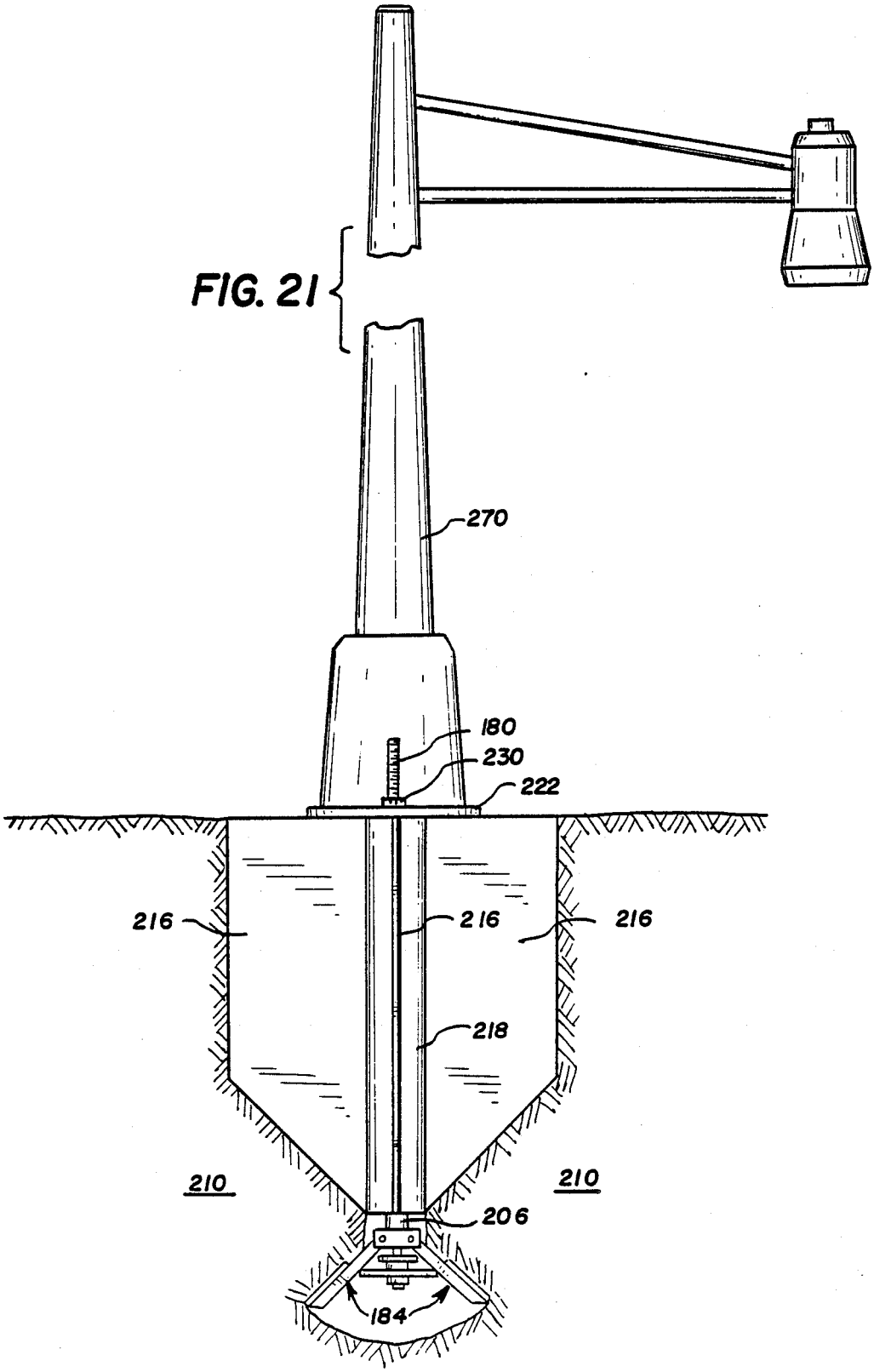
Figure 22:
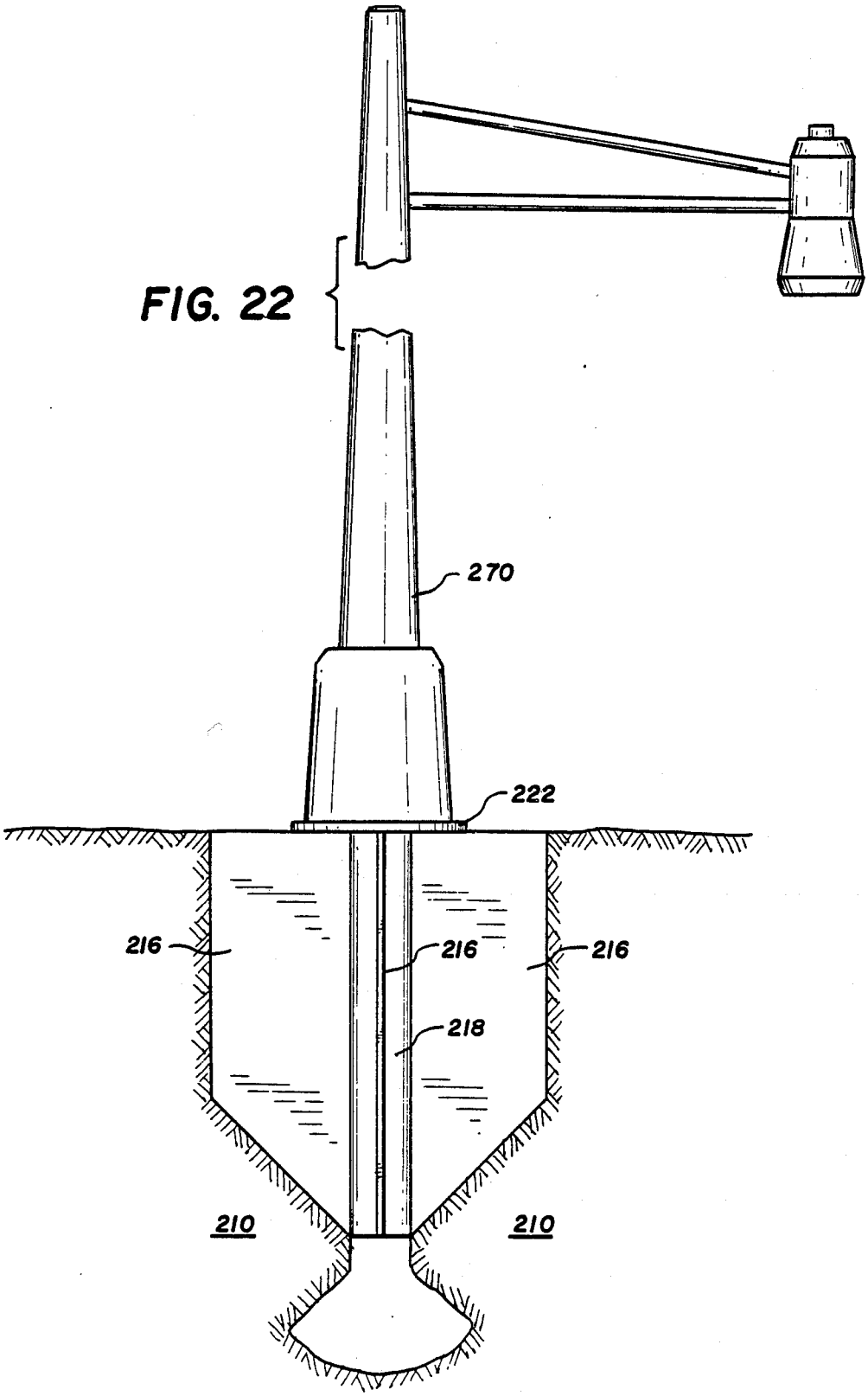
Figure 24:
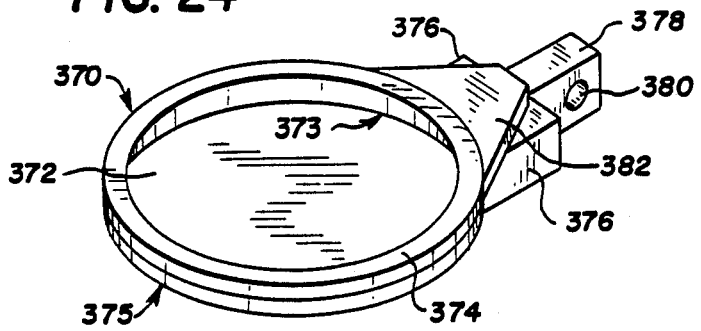
Figure 23:
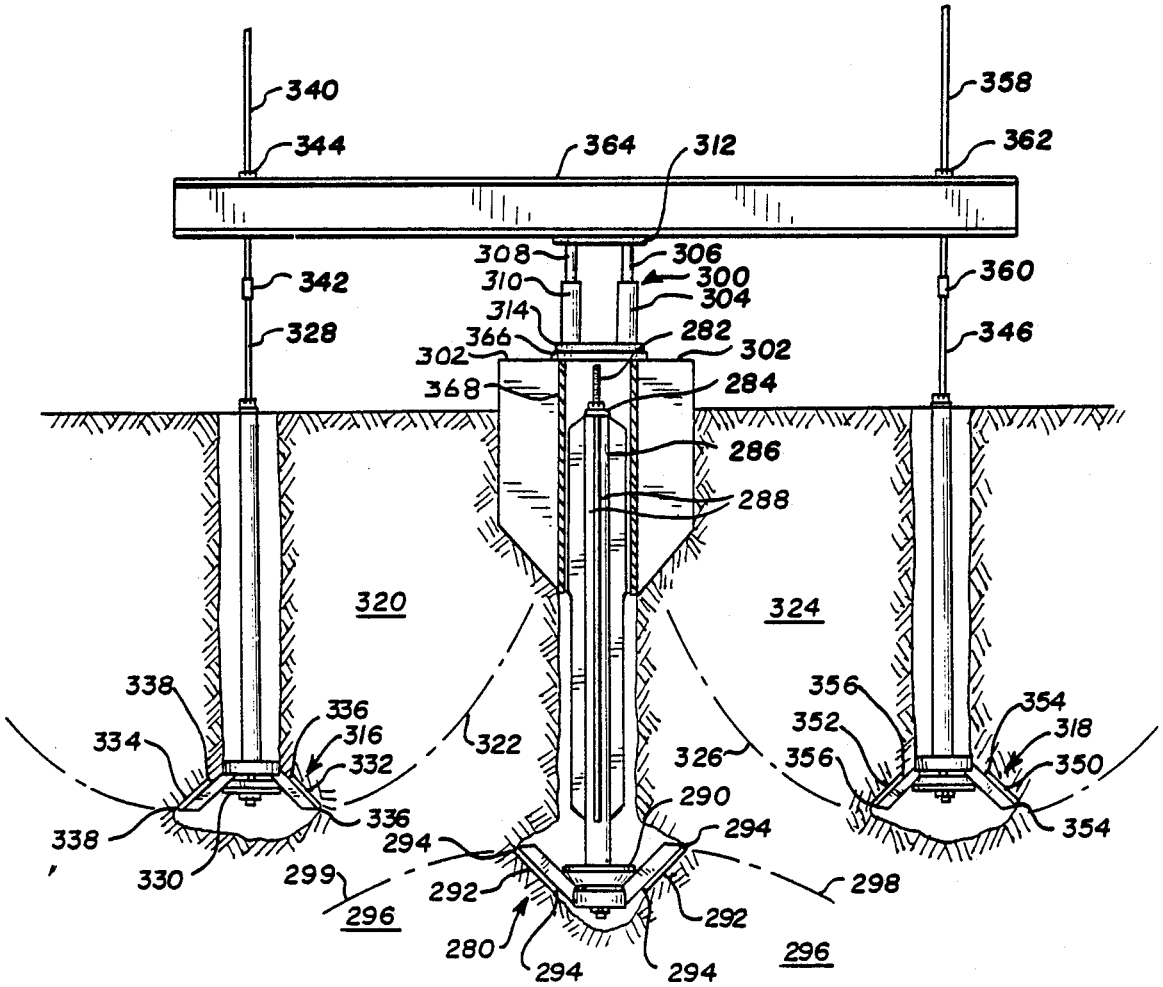
Figure 25:
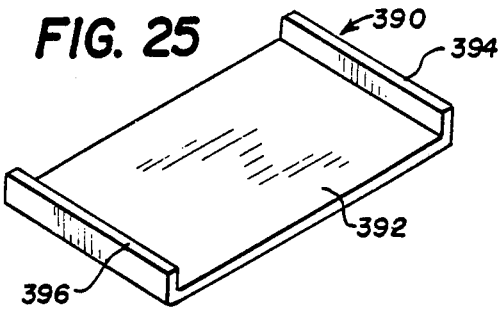
Figure 25A:
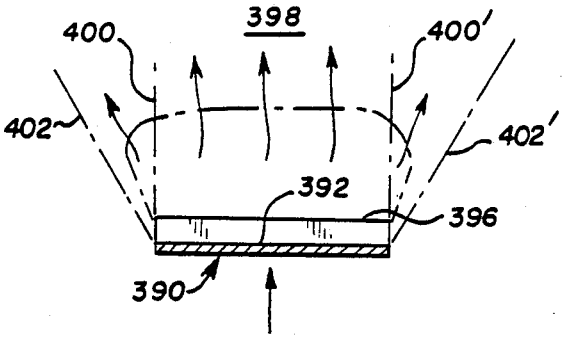
Figure 26:
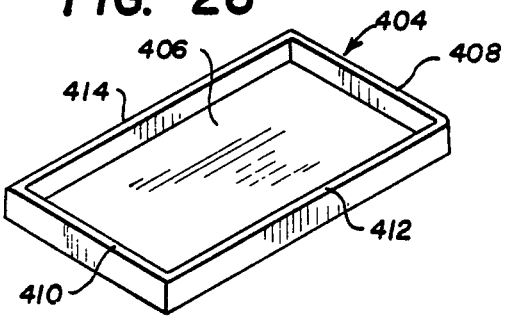
Figure 26A:
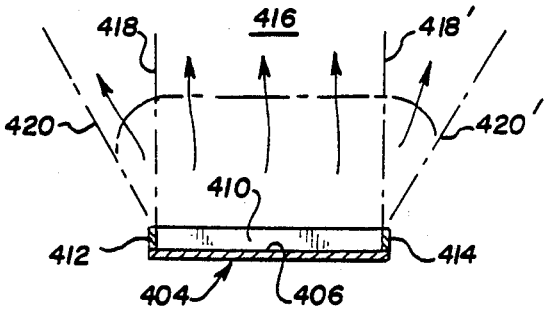
Figure 27:
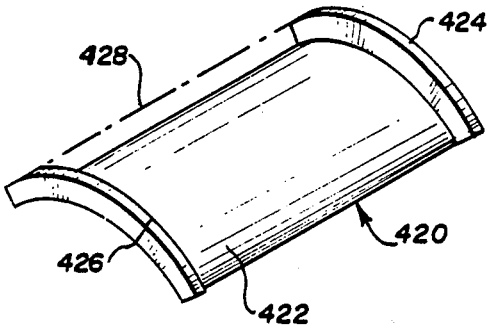
Figure 27A:
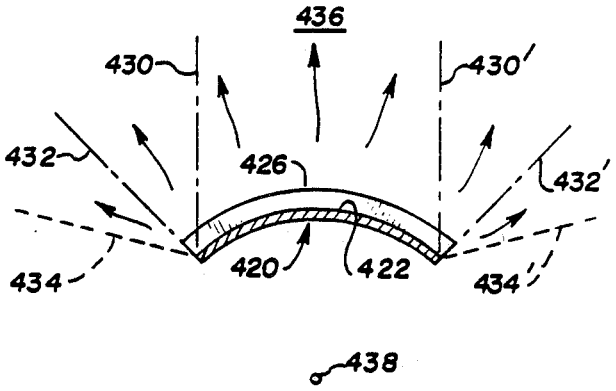

FIG. 6 presents a view of the side of a consolidating and shear control plate facing the containment media;

FIG. 7 presents a view of the other side of a consolidating and shear control plate;

FIG. 8 presents a detail view of the consolidating and shear control plate assembly in extension taken on the line VIII—VIII of FIG. 2;

FIG. 9 presents a dual hydraulic piston assembly of the invention;

FIG. 10 presents a dual hydraulic piston assembly of the invention in the the operational mode having force measuring means and arc measuring means;

FIG. 11 is an isometric view of an earth consolidation plate for use in rock media;

FIG. 12 is a side view of an earth consolidation plate for use in rock media;

FIGS. 13 and 14 are schematic views illustrating the extent of earth consolidation at varying arcs of swing of the preferred earth consolidation plates into surrounding media;

FIG. 15 is a schematic view illustrating the relatively limited shear plate developed with a non-preferred plate;

FIG. 16 is a schematic view illustrating the much greater shear plane developed with plates having earth containment means;

FIG. 17 is a partially cut away view of a device expanded in the anchor mode wherein the device is equipped with spacer vanes and adapted for receiving moment resisting stabilizer vanes;

FIGS. 18 and 19 are views illustrating the method of installing moment resisting stabilizer vanes on an anchor device employing the hydraulic setting tool of the invention;

FIG. 20 is an exploded view of component parts further illustrating the method of installing moment resisting stabilizer vanes employing the hydraulic setting tool of the invention;

FIGS. 21 and 22 illustrate two modes of utilizing an anchor device having moment resisting stabilizer vanes;

FIG. 23 illustrates the method of installing moment resisting stabilizer vanes on a foundation device employing a hydraulic setting tool of the invention;

FIG. 24 illustrates a circular embodiment of a compaction and consolidation plate;

FIGS. 25 and 25A illustrate a compaction and consolidation plate and its zone of influence in the surrounding media, respectively;

FIGS. 26 and 26A illustrate another compaction and consolidation plate and its zone of influence in the surrounding media, respectively;

FIGS. 27 and 27A illustrate still another compaction and consolidation plate and its zone of influence in the surrounding media, respectively; and Referring first to the anchor mode of FIGS. 1, 2 and 3 it is seen that elongated steel rod 10 is provided with bottom threads 12. The bottom end of rod 10 is then inserted into the central opening of pivot plate assembly 22 which comprises pivot plate 24 having a plurality of consolidation and shear plates 26 swingably attached thereto on pivot pins 28. The bottom end of rod 10 is thereupon inserted into the central opening of a spreader assembly 14. Spreader assembly 14 has an upper and smaller spreader section 16 connected to a lower and larger spreader section 18 by means of a collar 20. Sections 16 and 18 can be joined to form a comparable frusto-conical member. Section 16 can constitute a mechanical stop and serve as limiting means to limit the angular spread accomplished by section 18. Also, the angle between sections 16 and 18 can determine the upper limit of the setting range. Spreader assembly 14 and pivot plate assembly 22 are both slidable on rod 10 along their central openings and are prevented from falling from the bottom end of rod 10 by bottom retainer nut 27.

The partially assembled device comprising rod 10, bottom retainer nut 27, spreader plate assembly 14 and pivot plate assembly 22 is lowered to the bottom of augered earthen hole 80, as shown in FIG. 3. The device is lowered into the earthen hole with consolidating and shear control plates 26 nested compactly against the central rod 10 as shown in FIG. 1, so that spreader 18 is the widest element in the assembly. Therefore, the diameter of augered hole 80 need be only slightly larger than the largest dimension of spreader 18. Thereupon, pipe column 30 having upper flange 32 is mounted on and slid downwardly along rod 10 until its bottom end 34 abuts against the upper surface of pivot plate 24. An hydraulic piston assembly of any type 36 having a central opening 37 is then mounted on and slid downwardly along rod 10 until the bottom end thereof abuts against flange 32 of pipe column 30.

Hydraulic piston assembly 36 comprises an outer cylinder wall 40 and an inner partial cylinder wall 42 defining an annulus 44. Annulus 44 is provided with a movable piston assembly 46 comprising a piston head 48 within annulus 44 and a hollow piston arm 50 extending upwardly out of the interior of annulus 44 through an opening 45 in the top of cylinder 36. Piston arm 50 is also provided with a shoulder 52 at its terminus Rod 10 is provided with upper threads 54 for securing upper retainer nut 56 to rod 10. Upper retainer nut 56 is positioned on threads 54 to cause upward movement of rod 10 with piston assembly 46.

Annulus 44 is divided by piston head 48 into oil filled compartments 66 and 68. Compartment 66 is provided with nipple 58 for attachment to a flexible hose 60 for passage of hydraulic fluid to compartment 66 from a hydraulic pump (not shown) to actuate the device (FIG. 3). Compartment 68 has a nipple 64 for attachment to a flexible hose for passage of hydraulic fluid from compartment 68 back to the hydraulic pump reservoir. Although oil is the preferred hydraulic fluid, any other convenient liquid can be used. Also pressurized air can be employed.

When hydraulic fluid is charged to pressure chamber 66, pressure is exerted against piston head 48. The force on piston head 48 forces the piston upwardly to exert an upward force against retainer nut 56. The pressure exerted against piston head 48 forces rod 10 upward while holding pivot plate 24 vertically stationary through a downward force exerted through setting and load bearing column 30. The only avenue of freedom for expansion of compartment 66 to accommodate a continuing increase in fluid pressure is in an upward movement of piston head 48. Such an upward movement allows high pressure compartment 66 to expand into low pressure compartment 68. The expansion of compartment 66 is illustrated by comparing FIGS. 1 and 2 whereby it is seen that pressure chamer 66 is relatively small in FIG. 1 and is relatively large in FIG. 2.

The upward movement of piston assembly 46 pushes upwardly on retainer nut 56 and moves rod 10 and spreader plate assembly 14 up to spread open the consolidation and shear plates 26 on pivot plate assembly 22. The consolidation and shear plates 26 are thereupon forced out on arc which extends outwardly and upwardly under the influence of spreader assembly 14. Consolidation and shear plates 26 swing outwardly by rotation on pivot pins 28 cutting an arc 82 into earthen wall 80 and creating extreme forces. While this swinging occurs, pipe column 30 bears down on pivot plate assembly 22 to serve as restraining means to restrain vertical movement of pivot plate assembly 22. External forces are brought to bear upon the media by the outward movement of the consolidation and shear plates creating consolidation and compaction of the media and positioning of the shear plane away from the consolidation plates and outwardly in the media. This positioning of the shear plane out in the load bearing media is controlled by shear bars or ribs 72 in cooperation with the surface of plates 26 facing the media to contain the media. Further, the normal zone of influence is greatly increased in direct proportion to the degree of consolidation and compaction of the media.

After consolidation and shear plates 26 have been spread to achieve the desired device strength within the setting range for a determined design load, the pressure in chamber 66 can be relieved, and upper retainer nut 56 removed and hydraulic piston assembly 36 slid upwardly and off of rod 10. Hydraulic piston assembly 36 can then be reused in other applications.

The above-described setting action causes the spreader assembly 14 to force the consolidation and shearing plates 26 outwardly generating compaction, consolidation and positioning of the shear plane in the direction indicated by arrows 74. The total delivered setting force as measured by the reading on gauge 62 (FIG. 3) is translated to consolidation and shear plates 26 causing compaction, consolidation and positioning of the shear plane of the bearing soil strata as indicated by arrows 74, as shown in FIG. 3. Gauge 62 reads the developed shear strength of the loaded media at any position within the setting range. At this point the media has been pre-stressed to achieve a loading consolidation equivalent to or greater than the design load. The desired and permanent strength of the media has been achieved through the compaction, consolidation and positioning of the shear plane in the media.

The movement of consolidation and shear plates 26 into the media allows the device in the anchor mode to utilize both the enlarged zone of influence and the shear strength of the media. A controlled shear plane bearing surface is created during compaction and consolidation by the shearing bars or ridges 72 on consolidation and shearing plates 26. An external source of pull or tension, such as a guy wire, can be coupled to rod 10 at upper threads 54 to convert rod 10 into an anchor rod. The hole can then be backfilled or not as desired, depending on the temporary or permanent nature of the installation.

The reading on gauge 62 is the strength of the anchor. A low reading on gauge 62 at full extension or a high reading prior to extension into the preferred setting range indicates that the device must be reset. The device may be removed from the hole by inserting pulling hooks into eyes 76 and then lifting. Inclined ramp 93, shown in FIG. 6, prevents rib 72 from getting caught in the earth during lifting. The earthen hole 80 can then be augered to a greater depth or the consolidation and shear plates can be changed to develop the needed strength at proper extensions. Upon resetting, a desired strength will be indicated by the appropriate reading on gauge 62 within the setting range.

Figure 5:
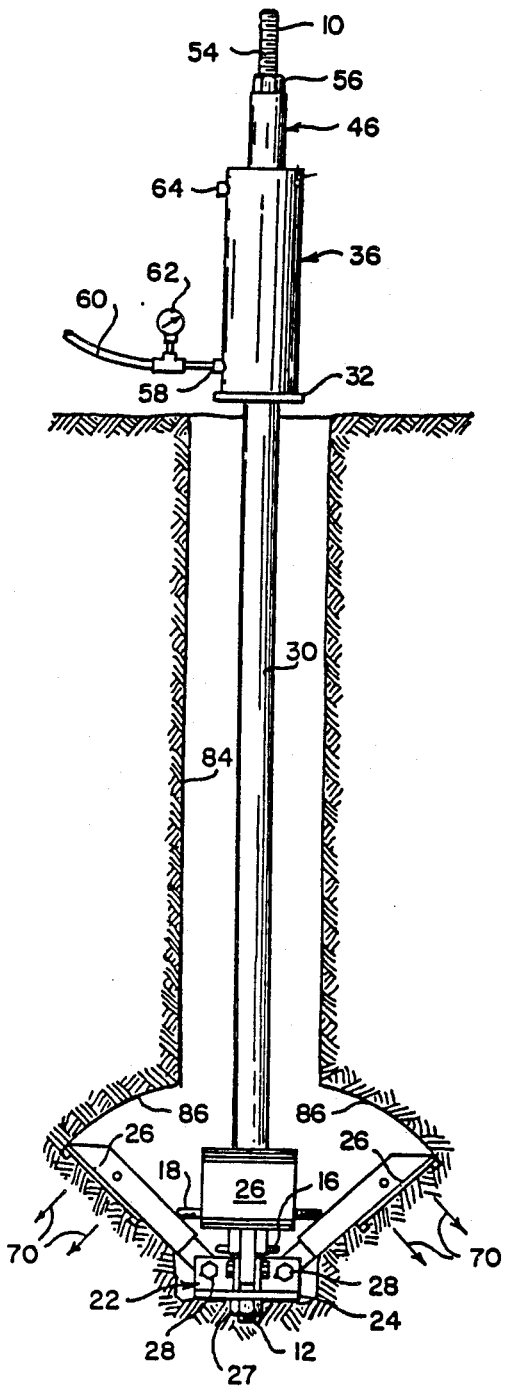
FIG. 5 illustrates a device extended for operation within the foundation mode and positioned in an earthen hole.
Figure 4:
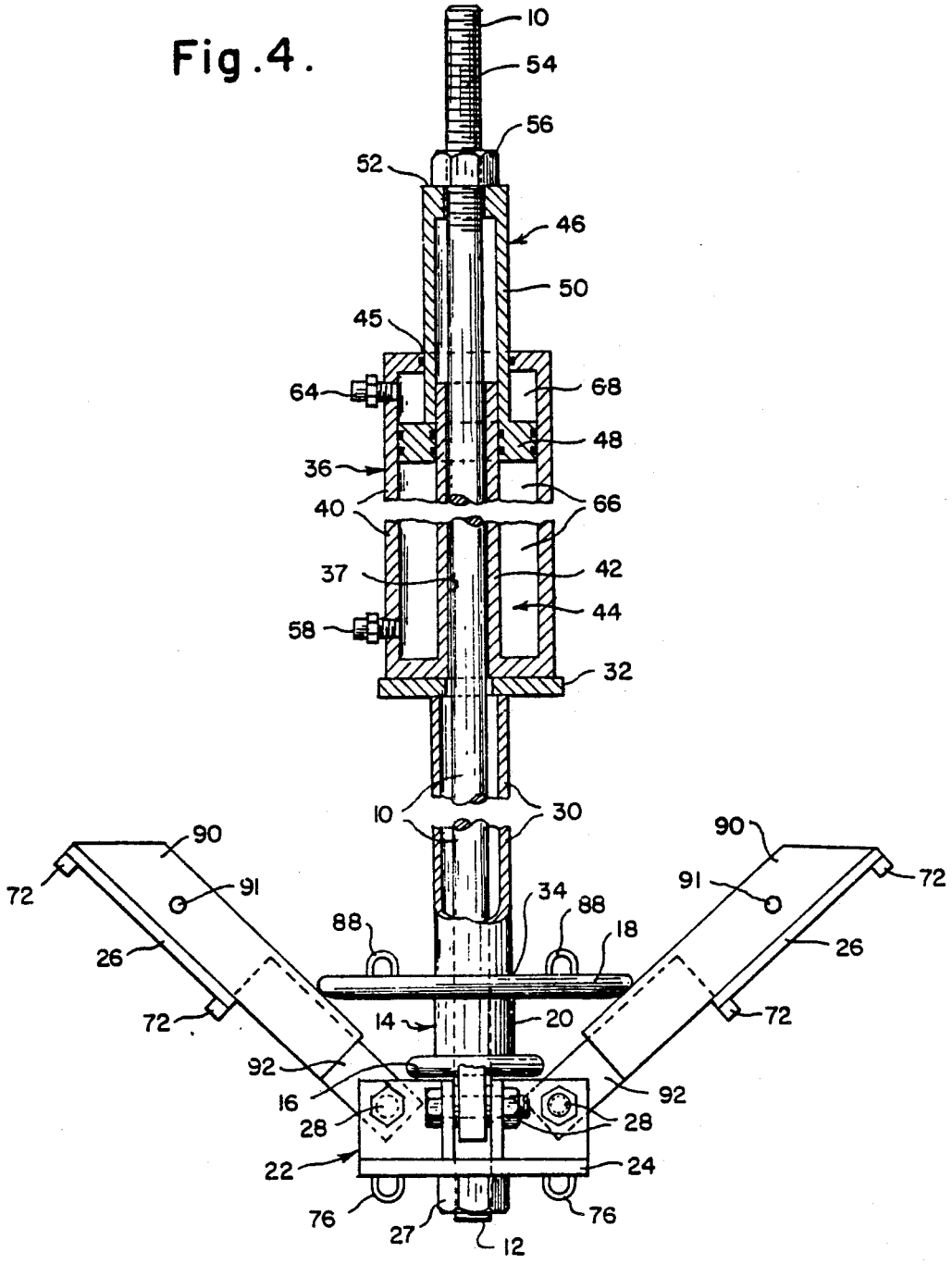
FIG. 4 illustrates a device extended for operation within the foundation mode.

The foundation mode illustrated in FIGS. 4 and 5 utilizes exactly the same parts as the anchor mode. However, in the foundation mode the combination of spreader plate assembly 14 and pivot plate assembly 22 is reversed and each is inverted, as compared to the anchor mode. This reversal and inversion are the only required changes and are accomplished at the time of assembly. In assembling the device for the foundation mode, the bottom of rod 10 is inserted into the central opening of spreader plate assembly 14, followed by the insertion of the bottom of rod 10 into the central opening of pivot plate assembly 22 which in turn is followed by the screwing into position of bottom retained nut 27. Plate 16 abutting against pivot plate assembly 22 constitutes limiting means to limit the ability of spreader 18 to spread plates 26 to an arc substantially greater than 45 or 55 degrees.

Rod 10 having spreader plate nut 27, pivot plate assembly 22 and spreader plate assembly 14 mounted thereon is lowered to the bottom of augered earthen hole 84, shown in FIG. 5. Thereupon, pipe column 30 is lowered down rod 10 until its bottom 34 rests on spreader plate 18. Hydraulic piston assembly 36 having a central opening is then lowered down rod 10 until it rests on flange 32 of pipe column 30. Retainer nut 56 is then screwed into place on upper threads 54 of rod 10.

Hydraulic pressure is applied to pressure chamber 66 through hose 60 (FIG. 5). The pressure is indicated on gauge 62. The pressure upon piston head 48 is exerted through shoulder 52 against upper retainer nut 56. Since piston 48 is restrained by nut 56, increasing fluid pressure in chamber 66 causes chamber 66 to expand and force cylinder 40 downwardly against flange 32 of pipe column 30 and thence downwardly against spreader plate assembly 14, pivot plate assembly 22 and bottom retainer nut 27.

The above setting action causes relative movement between rod 10 and pipe column 30 causing the spreader plates 16 and 18 to pivot the consolidation and shear plates 26 outwardly and downwardly into the sides of the earthen hole, cutting arc 86 into the media. Nut 27 restrains plate assembly 24 from vertical movement. The total delivered setting force is translated to consolidation and shear plates 26, causing compaction and consolidation of the bearing soil strata outwardly and downwardly in the direction indicated by arrows 70 (FIG. 5). The result of this consolidation and compaction is that a foundation having an enlarged zone of influence is created for resisting any sinking of the structure into the earth.

The reading on gauge 62 is an indication of the strength of the foundation. A low reading on gauge 62 indicates a low resistance to compaction and consolidation of the media at plates 26, as in a soft or sandy soil. The device can be pulled out of hole 84 after inserting pulling hooks into eyes 88 on spreader plate 18 and after inserting grappling means, not shown, to engage bars 91 on the underside of each consolidation and shear plate 26 (FIGS. 1 and 4). The earthen hole 84 can then be augered to a greater depth at which a harder media or rock formation is available to provide a greater resistance to compaction and consolidation at plates 26, and larger plates may be attached. A greater resistance will be indicated by a high reading on gauge 62 and will provide a more secure foundation.

After consolidation and shear plates 26 have been securely embedded into the earth, the pressure in hydraulic piston assembly 36 is relieved and piston assembly 36 is removed, as earlier described, and reused elsewhere.

When the device is in use in the foundation mode, a building structure will exert a downward force on pipe column 30 spreader plate assembly 14 and thence on consolidation and shear plates 26. This downward force will be resisted by the compacted and consolidated media under plates 26. Because the earth has been compacted and consolidated as indicated at arrows 70 the bearing capacity of the small foundation device as shown in FIGS. 4 and 5 is comparable to a large concrete pile construction without the large costs inherent thereto. Unlike the guess work and conservative oversized volumes of concrete required to ensure adequate support, the foundation of our invention has a known set strength, which is indicated by gauge 62.

FIGS. 6 and 7 illustrate the opposite sides of consolidation and shear plates 26 and show shear plane control ribs 72. Ribs 72 extend along at least two edges of plates 26, as shown in FIG. 6, wherein facing ribs 72 are disposed oppositely from each other and extend along the lower and upper edges of plates 26. If desired, ribs 72 can extend along all four edges of rectangular consolidation and shear plates 26. The side of consolidation and shear plates 26 which contacts spreader assembly 24 is braced by cheek plates 90. Cheek plates 90 embrace a pivot arm 92 having an opening 94 for receiving pivot pin 28, indicated above.

FIG. 8 is a detailed plan view of the anchor mode of the consolidation and shear plate assembly in extension along the line VIII—VIII of FIG. 2. There is always a plurality of compression and shear plates 26 and the preferred number is four, as shown in FIG. 8. All the parts indicated in FIG. 8 were explained above. However, FIG. 8 is presented to more clearly illustrate how compression and shear plates 26 swing outwardly on pivot pins 28 under the influence of spreader assembly 14. Spreader assembly 14 rides entirely behind plates 26.

Tests conducted on prototypes of both the anchor and foundation modes of the device have shown strengths, as indicated by gauge readings, that previous devices and constructions could only achieve with much larger mass, much greater depth, or a combination of both. Moreover, the strengths of the present device are known with confidence because of the gauge readings while the actual strengths of the previous devices cannot be known.

FIG. 9 shows an hydraulic setting tool of the invention comprising a dual hydraulic piston assembly including hydraulic cylinders 100 and 102, having ports 104 and 106, respectively, for the admission of hydraulic fluid. The assembly includes lower supporting plate 108 having central opening 110 and upper lifting plate 112 having central opening 114. The assembly is mounted on pipe column 116 having an upper flange 118 with central opening 120. Rod 122 having threaded regions 124 and 126 for receiving holding nut 128 and restraining nut 130, respectively, extends through and above pipe column 116 and flange 118. Vertical movement of rod 122 actuates consolidation and shear plates, not shown. Prior to engaging restraining nut 130 on rod 122, the entire hydraulic piston assembly is mounted about rod 122 and rests upon flange 118. Thereupon, restraining nut 130 is screwed onto threads 126 and against plate 112.

The operation of the dual hydraulic piston assembly of the invention is illustrated in FIG. 10. Fluid under pressure is admitted to hydraulic ports 104 and 106 to actuate pistons within cylinders 100 and 102 which in turn forces piston rods 132 and 134 upwardly. Upward movement of piston arms 132 and 134 lifts plate 112 which in turn raises rod 122 by means of restraining nut 130. The vertical movement of rod 122 causes the spreading of subterranean consolidation and shear plates, not shown. The hydraulic piston assembly is provided with a calibrated scale 136 which relates the extent of lift of piston arms 132 and 134 to degrees of arc opening of the consolidation and shear plates. The assembly is also provided with gauge 138 which is connected to the hydraulic piston assembly through lines 139 and 140. Gauge 138 is calibrated to indicate the force developed to swing the consolidation and shear plates into the surrounding media and is also calibrated to indicate the installed strength developed in the media by the device. It has been determined that the force required to dislodge the device equals the force required to swing the consolidation and shear plates into the surrounding media times a factor of 0.7.

After the consolidation and shearing plates are properly swung into the surrounding media, the hydraulic force can be released. The vertical position of rod 122 may thereafter be secured by screwing holding nut 128 downwardly on threads 124 to position 128', where it abuts against flange 118 to prevent any lowering of rod 122. Thereupon, restraining nut 130 can be removed from rod 122 and the entire hydraulic piston assembly can be lifted from flange 118 for reuse at another location.

FIGS. 11 and 12 show consolidation and shear plate 142 for use in a rock media. Consolidation and shear plate 142 is provided with shear plane control bars 144 and 146 having leading edges 148 and 149, respectively, for biting into rock media. Plate 142 has a relatively narrow width of about one inch because of the hardness of the material which it encounters.

FIGS. 13 and 14 schematically illustrate the occurrence of compaction and consolidation of earth media around outwardly swinging plates 150, each having a pair of shear plane control bars or ridges 152. FIG. 13 shows plates 150 swung outwardly over a relatively small arc of 10 degrees, measured from the vertical. Some consolidation of earth into a rock-like material, as indicated at 154 is occurring within and near containment zones 156 defined by ridges 152 and the surface of plates 150 facing the media. The material beyond the consolidated material is compacted but non-consolidated earth, as indicated at 158.

FIG. 14 shows earth consolidation and shear plates 50 spread outwardly into the surrounding media over a greater arc of 45 degrees. It is seen that the rock-like formation 160 due to consolidation is now greatly extended, compared to FIG. 13. It is noted that the ridges 152 provide locking ledges, as indicated at positions 162, resisting any shear of rock-like formation 160 relative to the surface of plates 150 upon dislodgement.

The enlargement of shear plane upon dislodgement when employing the consolidation and shear plates of this invention is illustrated by a comparison of FIGS. 15 and 16. FIG. 15 shows plates 164 which are not equipped with the shear plane control bars of this invention extended into surroundng earth media over an arc of 90 degrees, which is the customary arc for plates not equipped wih the shear plane control bars of this invention. The shear plane generated upon dislodgement is indicated at 166 and 166'. FIG. 16 shows consolidation plates 168 each provided with a pair of shear plane control bars 170. Plates 168 are extended into the surrounding earth media over an arc of 45 degrees. A much greater shear plane as indicated at 172 and 172' is generated upon dislodgement, as compared to shear plane 166 and 166' of FIG. 15. Consolidation and shear plates 168 having ridges 170 provide their maximum shear plane at an extension of 45 degrees, and the shear plane would decrease at an extension greater than 45 degrees. The prior art device of FIG. 15 does not have a comparable critical arc of extension.

FIG. 17 illustrates an anchor device adapted to support moment stabilizer vanes, such as moment stabilizer vanes 216 shown in FIG. 18. The device of FIG. 17 includes vertical support rod 180 which can be threaded along its entire length. The effective length of rod 180 can be extended by attachment to another rod by means of internally threaded coupling 182. A plurality (preferably four) of swingable media compaction and consolidation plates 184 are provided with each plate having a media facing surface 186 with oppositely disposed ribs 188 and 190 extending along the upper and lower edges of said plates, respectively. The bottom side of plates 184 is supported by a pair of cheek plates 192 between which is disposed pivot plate 194. Each pivot plate 194 is pivotally engaged to spreader assembly 195 by pivot pins 196. Inclined ramp plates 193 extend downwardly from the top of each lower rib 190 to pivot plate 194. Spreader assembly 195 is equipped with upper bearing plate 198.

In FIG. 17, media consolidation plates 184 are shown to swing outwardly on pivot pins 196 under the urging of spreader plate 200 which rests against lower retainer nut 202. Upper retainer nut 204 retains pipe column 206 on rod 180. Pipe column 206 is disposed about rod 180 and rests upon bearing plate 198. Pipe column 206 is provided with a plurality of radially or outwardly extending support vanes 208, which are used for supporting a moment stabilizing vane assembly, as illustrated in FIGS. 18, 19 and 20.

FIG. 18 shows an anchor device wherein earth consolidation plates 184 are expanded outwardly into the surrounding media to consolidate the surrounding media in the zone 210 as defined by expanded shear lines 212 and 213. Plates 184 in the collapsed position on rod 180 and prior to their expansion, as illustrated in FIG. 1, are lowered into augered hole 214. Pipe column 206 rests upon pivot plate assembly member 195. Pipe column 206 is provided with outwardly extending support vanes 208.

FIG. 18 illustrates the installation of the plurality (such as four) of moment resisting vanes 216 extending radially outwardly from hollow tube 218. The interior of hollow tube 218 is disposed around and may be in frictional contact with the outside edges of support vanes 208. If desired, tube 218 can be spaced apart from the outside edges of support vanes 208 to permit easy removal of the spreader plate assembly after installation of the moment resisting vanes by collapsing and withdrawing the spreader plate assembly. The installation of moment resisting vanes 216 is accomplished by attaching a threaded extension rod 220 to rod 180 at coupling 182 and mounting tube 218 having moment resisting vanes 216 around extended rod assembly 180–220. Thereupon, bearing disk 222 is disposed around rod 220 so that it rests upon vanes 216. Finally, hydraulic motor unit assembly 224 is mounted on bearing disk 222. Motor unit 224 has two spaced-apart piston-cylinder motor units 226 and 228 which are side-by-side and diametrically oppositely spaced with respect to rod 220 and equidistant from rod 220 so as to avoid any significant bending moment on rod 220. Each cylinder 238 and 242 is fixedly secured to lower motor bearing plate 232 and each extendable and retractable piston arm 236 and 240 is fixedly secured to upper motor bearing plate 234. Lower bearing plate 232 and upper bearing plate 234 are parallel to each other. Hydraulic unit assembly 224 is secured in place by means of upper restrainer nut 230.

During the process of setting moment resisting vanes 216 into the earth, piston 236 is recessed within cylinder 238 and piston 240 is recessed within cylinder 242 so that upper motor bearing plate 234 is disposed relatively close to lower motor bearing plate 232. This is the retracted position shown in the exploded view of FIG. 20. As shown in FIG. 20, rod 220 ends through all of the following: central opening 244 in upper motor bearing plate 234; central opening 246 in lower motor bearing plate 232; central opening 248 in bearing disk 222 and opening 250 in tube 218. Tube 218 is part of an assembly which carries moment resisting vanes 216. Extension rod 220 is threadedly engaged with coupling 182 so that rod 220 forms a direct extension of rod 180. Upper retaining nut 230 secures the parts tightly together.

Piston arms 236 and 240 are equidistantly spaced with respect to central opening 244 and cylinders 238 and 242 are equidistantly spaced with respect to central opening 246 and the motors are diametrically opposite from rod 220 so that motor assembly 224 will not exert any bending moment on rod 220. As shown in FIG. 20, a linear measuring means can indicate the distance between upper motor bearing plate 234 and lower motor bearing plate 232 at any time during the moment resistant vane setting operation. For example, opposite ends of an unwinding tension-spring tape measure 252 can be attached to upper and lower plates 234 and 232, respectively.

FIG. 18 shows the hydraulic fluid circulation systems for piston-cylinder motor units 226 and 228. By the term "hydraulic fluid" is meant any fluid which can move the piston arms including liquids, such as oil, or pneumatic systems. Motor unit 226 is provided with hydraulic fluid access ports 252 and 254 while motor unit 228 is provided with hydraulic fluid access ports 256 and 258. Hydraulic fluid is supplied to lower ports 252 and 256 through a common conduit header 260 equipped with pressure gauge 264. The employment of a common fluid header to supply both motor units tends to guarantee that the extensions of 10 piston arms 236 and 240 will always be the same so that no significant bending moment on rod 220 can occur. Upper hydraulic fluid access ports 254 and 258 similarly are supplied through a common conduit header 262 when it is decided to retract piston arms 236 and 240. During retraction, ports 252 and 256 will be open.

FIG. 20 shows piston arms 236 and 240 in a substantially retracted position, which is the normal or start of operation position when no hydraulic pressure is being applied. FIG. 18 shows piston arms 236 and 240 in a fully extended position, which is the end of operation position, at which time full fluid pressure is being applied through conduit 260, as indicated on pressure gauge 264. At the end of operation position shown in FIG. 18 the bottom portion only of moment resisting vanes 216 is forced into the earth to the depth indicated at 266. However, the greater portion of the vanes is still above the earth. This position represents the completion of the first action stage of the motor unit in submerging the vanes in the earth.

After pistons 236 and 240 reach the fully extended position shown in FIG. 18, the hydraulic pressure in conduit 260 is relieved by a venting means, now shown, and hydraulic fluid is then introduced through conduit 262 into upper fluid ports 254 and 258 to force pistons 236 and 240 to retract into cylinders 238 and 242, respectively. Thereby upper motor bearing plate 234 moves downwardly along rod 220. Then, upper restraining nut 230 is rotated to move it downwardly on threaded rod 220 until it firmly abuts motor bearing plate 234 at the lower position of plate 234.

Now, the hydraulic pressure in conduit 262 is vented and hydraulic pressure is reapplied to conduit 260 to cause reextension of piston arms 236 and 240 from cylinders 238 and 242, respectively. Because of upper restraining nut 230, the hydraulic motor erects a tensile force on rods 220 and 180. Because rods 220 and 180 are secured by the anchor in the earth, nut 230 prevents any upward movement of plate 234 when hydraulic pressure is applied through conduit 260. Thereby, there is a resultant downward push exerted by cylinders 238 and 242 against vanes 216, forcing vanes 216 deeper into the earth.

It will be appreciated that as vanes 216 are pushed progressively more deeply into the earth, lower motor bearing plate 232 will be pushed to progresssively lower levels relative to rod 220 until plate 232 descends below one or more rod couplings, such as coupling 182. Central opening 246 in lower motor bearing plate 232 must be sufficiently large to allow the passage of coupling 182 therethrough. Because coupling 182 has a larger outer diameter than rod 180 or 220, it is not feasible to employ a single, central motor, as shown in FIG. 1, for setting a moment resisting vane. Therefore, we employ at least a pair of side-by-side motors symmetrically offset from the center and positioned so that the two motors and the central opening for a straight line. When employing a plurality of motors, the motors apply individual downward forces which are balanced about center rod 220. Otherwise, a destructive bending moment would be exerted on rod 220.

The described procedure can involve multiple hydraulic pressure and venting sequences at the motor means with concomitant multiple extensions and retractions of the piston arms with a turn-down of upper restraining nut 230 occurring following each retraction while one or more couplings such as coupling 182, are traversed by opening 246. When a coupling becomes positioned at an elevation higher than upper motor bearing plate 234, it will be necessary to remove the coupling and the rod attached to the upper end of the coupling. Thereupon, upper restraining nut 230 will be attached to the rod attached to the lower end of the coupling.

The described series of procedural steps will be repeated until moment resisting vanes 216 are entirely embedded within the earth so that the bottom of the vanes reach the depth indicated at 268 in FIG. 18. This full depth final position of vanes 216 is more fully illustrated in FIG. 19. FIG. 19 shows piston arms 236 and 240 fully extended and hydraulic motors 226 and 228 at a position such that coupling 182 is above lower motor bearing plate 232 and bearing disk 222 is flush with the ground. In this position, vanes 212 are fully submerged below ground level 270. FIG. 19 shows that vanes 216 are not only fully submerged but also are embedded in consolidated earth zone 210, as demarked by shear lines 212.

FIG. 19 illustrates the interdependence between the use of the moment resisting vanes 216 and earth containment ribs 188 and 190 on earth consolidation plates 184. As explained above, ribs 188 and 190 enhance the size of media consolidation zone 210, as indicated by outwardly flaring shear lines 212. The relatively great width of consolidation zone 210 permits relatively wide vanes 216 to be embedded in consolidated media along the entire width of vanes 216. Relatively wide earth consolidation zone 210 provides a secure foundation for vanes 216 by providing both an enhanced resistance to any rotational moment in the vanes and an enhanced frictional resistance against any tensile force urging withdrawal of the vanes.

FIGS. 21 and 22 illustrate an anchor having moment resisting vanes 216 used to support an above-ground structure, such as lamp post 270. As shown in FIG. 21, vanes 216 are completely immersed or embedded in the earth, allowing the removal of hyraulic motor unit 224 which was shown in FIG. 19. FIG. 19 shows that hydraulic motor unit 224 can be easily removed from the system after the setting of vanes 216 is completed by removing upper retainer nut 230 and then lifting motor unit 224 as a unitary structure off of upper threaded rod 220. Thereupon, upper rod 220 and coupling 12 can also be removed from the system, leaving lower rod 180 and bearing disk 222 in place. Upper restraining nut 230 is then applied to lower rod 180 to secure disk 222.

Rod 180 and lower bearing disk 222 can then be used in any suitable attachment mechanism to secure lamp post 270 in place. FIG. 21 shows an embodiment wherein bearing disk 222 is secured to the top of vanes 216 by means of upper restraining nut 230. If desired, bearing disk 222 can also be welded to the top of vanes 216. Then, the assembly comprising rod 180, restraining nut 230 and bearing disk 222 can be used to construct any suitable attachment means (not shown) for securing lamp post 270 to the anchor and the vanes.

Because vanes 216 are embedded within media zone 210 which comprises consolidated earth, the vanes are highly secure against bending moments and tensile or compressive forces. In fact, vanes 216 may be held sufficiently securely within the earth that the anchor which includes media consolidation plates 184 is no longer required. Thereby, the anchor can be collapsed and removed from the system by being drawn upwardly through tube 218 to which vanes 216 are attached. Then, bearing disk 222 can be secured to the top of tube 218 and vanes 216 by any suitable means, such as by welding. Thereupon, lamp post 270 can be mounted on and secured by any suitable means to bearing disc 222. Vanes 216 without the assistance of the anchor may provide adequate support for lamp post 270 against bending momens and tensile and compressive forces.

Referring to FIGS. 18 and 19, it is seen that in setting vanes 216 into the earth, pistons 236 and 240 bear upwardly against upper bearing plate 234 and upper restraining nut 230. This imparts a tensile stress in vertical tension rods 220 and 180 which urges spreader plate 202 upwardly which in turn swings plates 184 outwardly against the surrounding media. Thereby, the direction of forces required for setting vanes 216 into the earth is the same as the direction of forces required for setting the anchor in the earth. Therefore, the anchor can first be set and subsequently the vanes are set by bearing on the strength of the anchor, i.e. by using the anchor as a support. The use of the anchor of this invention as a bearing or support for setting the vanes represents an interdependent and cooperative aspect of the anchor and vane setting methods. However, as shown below, a foundation apparatus of this invention cannot be similarly used in setting surrounding moment resisting vanes.

FIG. 23 shows a foundation device 280 secured into the earth. Whereas an anchor device is adapted to resist an above-ground upward or tensile force, a foundation device is adapted to resist an above-ground downward or compression force. Therefore, an anchor device is set by means of an above ground upward or tensile force and a foundation device is set by an above ground downward or compression force. When foundation device 280 is being set, a downward or compression force is applied by means (not shown) on pipe column 286 which is provided with spacer vanes 288. Pipe column 286 in turn forces plates 292 to swing outwardly into the surrounding media so that ribs 294 cooperate with the media facing surface of plates 292 to consolidate the media within zone 296, as defined by shear lines 298 and 299.

After foundation device 280 is set, as shown in FIG. 23, foundation device 280 itself cannot be used by hydraulic motor 300 as a bearing support in setting moment stabilizer vanes 302. The reason is that if rod 282 were attached to upper motor bearing plate 312, media consolidation plates 292 could not offer full resistance against motor 300 because the resulting tensile force on rod 284 would tend to separate spreader 290 from media consolidation plates 292. However, it was shown above that an anchor device does provide a suitable support when a hydraulic motor exerts a force on upper bearing plate 312. Therefore, in accordance with this invention when setting moment stabilizer vanes 302 around foundation device 280, external anchor devices 316 and 318 are set on opposite sides of anchor device 280 so that devices 316, 318 and 280 are aligned and can be spanned by cross beam 364 Thereby, cross beam 364 can serve as an upper bearing plate for motor 300 and cross beam 364 will bear upon anchors 316 and 318.

Anchor devices 316 and 318 are each set into the media adjacent to foundation device 280 and are on opposite sides of and preferably about equidistant from foundation device 280. Anchor device 316 provides media consolidation zone 320 defined by shear line 322 and anchor device 318 provides media consolidation zone 324 defined by shear line 326. Advantageously, moment resisting vanes 302 are sufficiently wide so that at least one of vanes 302 becomes embedded within each of the consolidation zones 320 and 324, respectively, thereby achieving enhanced moment resistance against turning and frictional resistance against dislodgement than if vanes 302 were embedded within non-consolidated media.

In this manner, lateral anchor devices 316 and 318 provide multiple and interdependent effects when utilized for setting vanes 302 around foundation device 280. First, the anchors provide a bearing support for the setting operation of vanes 302 and, secondly, anchors 316 and 318 each provide consolidation zones for receiving vanes 302 and enhancing the moment resistance thereof.

Anchor device 316 is set in the earth using hydraulic motor means, not shown, to pull upwardly on rod 328 which in turn pulls upwardly on plate spreader 330 to swing spreader plates 332 and 334 outwardly to establish an earth anchor. Upper and lower containment ribs 338 cooperate with the media facing surface of plate 334 and upper and lower media containment ribs 336 cooperate with the media facing surface of plate 332 to provide respective media consolidation zones, such as zone 320 defined by shear line 322. Zone 320 is sufficiently close to foundation device 280 that a moment resisting vane 302 will become embedded within consolidation zone 320. After anchor 316 is set, threaded extension rod 340 is attached to the end of rod 328 by means of coupling 342.

Anchor device 318 is similarly set in the earth using hydraulic motor means, not shown, to pull upwardly on rod 346 which in turn pulls upwardly on plate spreader 348 to swing spreader plates 350 and 352 outwardly to establish an earth anchor. Upper and lower media containment ribs 354 cooperate with the media facing surface of plate 350 and upper and lower media containment ribs 356 cooperate with the media facing surface of plate 352 to provide respective media consolidation zones, such as zone 324 defined by shear line 326. Zone 324 is sufficiently close to foundation device 280 that a moment resisting vane 302 will become embedded within consolidation zone 324. After anchor 318 is set, threaded extension rod 358 is attached to the end of rod 346 by means of coupling 360.

Beam 364 can be a steel I-beam and is provided with suitably positioned holes, not shown, to receive rods 340 and 358, respectively, while beam 364 rests upon upper motor bearing plate 312. Restrainer nuts 344 and 362 are installed to prevent upper movement of beam 364. Bearing disk 366 is placed on tube 368 when carries moment resisting vanes 302 and then hydraulic motor 300 is deposited on bearing disk 366. Initially, piston arm 306 is recessed within cylinder 304 and piston arm 308 is recessed within cylinder 310. In this initial, non-expanded condition of motor 300, upper bearing plate 312 is out of contact with the lower edge of beam 364.

Thereupon, a source of hydraulic fluid under pressure, not shown, is applied to pistons 304 and 310 to cause outward extension of piston arms 306 and 308 and urge bearing plate 312 upwardy against the bottom edge of beam 364 which is the position shown in FIG. 23. Upward movement of beam 364 is prevented by nuts 344 and 362 so that beam 364 bears upon anchors 316 and 318. Because beam 364 cannot move upwardly, moment resisting vanes 302 are pushed downwardly into the earth, extending into consolidated earth zones 320 and 324.

If moment resisting vanes 302 are not entirely embedded within the earth after piston arms 306 and 308 are fully extended, the hydraulic fluid is removed from cylinders 304 and 310, allowing piston arms 306 and 308 to retract into cylinders 304 and 310, respectively. Bearing plate 312 and beam 364, will similarly descend because piston arms 306 and 308 support both of these members. Then restrainer nuts 344 and 362 are rotated downwardly until they again abut against the upper surface of beam 364. Hydraulic pressure is reapplied to force fluid into cylinders 304 and 310 to again urge plate against beam 364 and in turn to force vanes 302 downwardly into the earth. The series of steps involving application and removal of hydraulic fluid from motor means 300 and of lowering restraining nuts 344 and 362, as described, is repeated until moment resisting vanes 302 are entirely submerged within the earth.

FIG. 24 shows earth compaction and consolidation plate assembly 370. Plate 370 includes media facing surface 372 having a curved edge configuration which defines a circle but whose surface is flat. Surface 372 is entirely surrounded by circular media entrapment rib 374. The general region 373 and the diametrically opposite region 375 represent lower and upper edge regions, respectively, for purposes of media containment rib designation. The assembly also includes underlying cheek plates 376 which embrace pivot arm 378 having pivot opening 380. Kick-out plate 382 constitutes a ramp which inclines downwardly and away from the rib means at lower edge 373 towards pivot arm 378. Kick out plate 382 serves the function of preventing the rib at lower edge 373 from being caught in the media when the plate is used in the anchor mode and is being collapsed for removal from an earthen hole after being set.

Plate 370 illustrates a media consolidation plate of this invention having a curved edge configuration. Media consolidation plates of this invention can have circular or oval edge configurations as well as square or rectangular edge configurations. Plate 370 also illustrates that the media consolidation rib can extend around the entire periphery of media consolidation surface 372, as well as around only a portion of said periphery. When the rib extends around the entire periphery, the rib segment relatively close to pivot arm 378 is defined as the lower media containment rib and the opposing rib segment relatively remote from pivot arm 378 is defined as the upper media containment rib.

FIG. 25 shows media consolidation plate 390 having media facing surface 392 and inward and outward media containment ribs 394 and 396, respectively. FIG. 25A shows a cross-section of plate 390 taken across media facing surface 392 facing rib 396 and shows the zone in surrounding media 398 through which plate 390 exerts a compaction and consolidation influence upon an outward swing. FIG. 25A shows that the zone of compaction and consolidation projects vertically above the entire media facing surface 392 as indicated by broken lines 400–400'. In addition, the zone of compaction and consolidation influence diverges outwardly from each side edge of surface 392 at an angle of about 30 degrees on each side, as indicated by broken lines 402–402'. The distance between broken lines 402–402' illustrates the full lateral extent of the media compaction and consolidation zone 398.

FIG. 26 shows media consolidation plate 404. Plate 404 comprises media facing surface 406 and inward and outward media containment ribs 408 and 410, respectively. Plate 404 is also provided with side edge media containment ribs 412 and 414. FIG. 26A shows a cross-sectional view of plate 404 taken across media facing surface 406 facing rib 410 and shows the zone 416 in the surrounding media through which plate 406 exerts a compaction and consolidation influence upon an outward swing. The zone of compaction and consolidation influence projects vertically above the entire media facing surface 406 as indicated by broken lines 418–418'. In addition, the zone of compaction and consolidation influence diverges outwardly from surface 410 at each side edge thereof at an angle of about 30 degrees, as indicated by broken lines 420–420'. Thereby, the distance between broken lines 420–420' illustrates the full lateral extent of media compaction and consolidation zone 416.

FIG. 27 shows media and consolidation plate 420. Plate 420 comprises convex media facing surface 422 and inward and outward media containment ribs 424 and 426, respectively. Optionally, plate 420 can be provided with side media containment ribs, as indicated by dashed line 428. Media facing surface 422 is convex in the direction facing the media and ribs 424 and 426 comprise a convex arch to conform with the convex surface.

FIG. 27A shows a cross-sectional view of plate 420 taken across media facing surface 422 in the direction facing rib 426 and shows zone 436 in the surrounding media through which plate 420 exerts a compaction and consolidation influence upon an outward swing. FIG. 27A shows that the zone of compaction and consolidation influence is considerably greater when employing a convex media facing surface as compared to a flat media facing surface. For example, if surface 422 were flat, its vertically upward projection would be indicated by vertical dashed lines 430–430'. However, in the case of convex surface 422 the zone of compaction and consolidation is favorably influenced by the radius of curvature, as indicated by lines 432–432' extending radially outwardly from center of curvature 438 and intersecting the side edges of plate 420. Furthermore, the zone of compaction and consolidation influence diverges outwardly from radial lines 432–432' an additional 30 degrees on each side, to provide an ultimate enlarged lateral zone of influence indicated by the dashed lines 434–434'.

By comparing dashed lines 434–434' in the case of convex plate 420, with dashed lines 420–420' in the case of flat plate 406 and with dashed lines 402–402' in the case of flat plate 390, it is seen that the lateral zone of compaction and consolidation influence when employing a convex plate is advantageously considerably wider than the zone of lateral influence when employing a consolidation plate having a flat surface.

In the foregoing specification we have described a presently preferred embodiment of our invention and method of practicing the invention. However, it will be understood that the invention can be otherwise embodied and practiced within the scope of the following claims.

We claim:

1. In combination, an extendable hydraulic setting tool assembly and an earth anchor or foundation device, said setting tool assembly comprising side-by-side spaced apart hydraulic motive means, each of said motive means comprising a piston movable within a cylinder with said piston having a piston arm extending out of said cylinder, movement of each piston causing the associated piston arm to extend away from or retract into its associated cylinder, a cylinder bearing plate secured to the base of said cylinders, a piston arm bearing plate secured to the extended ends of said piston arms, entry means in each of said cylinders for charging hydraulic fluid thereto, entry of said fluid causing said piston arms to extend outwardly from said cylinders, said bearing plates being parallel to each other, a first bearing plate opening disposed in said cylinder bearing plate midway between said cylinders, a second bearing plate opening disposed on said piston arm bearing plate midway between said piston arms, said first and said second openings aligned with each other for the passage of a rod therethrough, said assembly adapted so that a change in hydraulic fluid pressure in said cylinders changes the distance between said bearing plates; and said earth anchor or foundation device having a rod extending therefrom, said rod extending through said aligned openings, restraining means on said rod for restraining movement of one of said bearing plates, the other of said bearing plates adapted for bearing on said device to set said device in the earth.

2. The setting tool assembly of claim 1 including a common fluid header for charging hydraulic fluid to each cylinder through said entry means.

3. The setting tool assembly of claim 1 including a plurality of entry means in each cylinder, said entry means disposed on each side of each piston for charging hydraulic fluid to either side of each piston.

4. The setting tool assembly of claim 1 including a pressure gauge for measuring the pressure of said hydraulic fluid 5. The setting tool assembly of claim 1 including a rod extending through said aligned plate openings and restraining means for restraining movement of one of said bearing plates on said rod.

6. The setting tool assembly of claim 1 including a threaded rod extending through said aligned plate openings with adjustable nut means on said threaded rod for restraining movement of at least one of said bearing plates.

7. The setting tool assembly of claim 6 wherein said nut is disposed on said rod above said piston arm bearing plate.

8. The setting tool assembly of claim 1 including measuring means for measuring the movement of said piston arms.

9. The setting tool assembly of claim 8 wherein said measuring means is mounted on a cylinder and measures the displacement of said piston arm bearing plate with respect to said cylinder.

10. In combination, an extendable hydraulic setting tool assembly and an earth anchor or foundation device, said setting tool assembly comprising side-by-side spaced apart hydraulic motive means, each of said motive means comprising a piston movable within a cylinder with said piston having a piston arm extending out of said cylinder, movement of each piston causing the associated piston arm to extend away form or retract into its associated cylinder, a cylinder bearing plate secured to the base of said cylinders, a piston arm bearing plate secured to the extended ends of said piston arms, entry means in each of said cylinders for charging hydraulic fluid thereto, entry of said fluid causing said piston arms to extend outwardly from said cylinders, said bearing plates being parallel to each other, a first bearing plate opening disposed in said cylinder bearing plate midway between said cylinders, a second bearing plate opening disposed on said piston arm bearing plate midway between said piston arms, said first and said second openings aligned with each other for the passage of a rod therethrough, said assembly adapted so that a change in hydraulic fluid pressure in said cylinders changes the distance between said bearing plates; and said earth anchor or foundation device equipped with a moment resisting vane assembly, said device having a rod extending therefrom, said rod extending through said aligned openings, restraining means on said rod for restraining upward movement of said piston arm bearing plate, said cylinder bearing plate adapted for bearing on said moment resisting vane assembly to force said vane assembly into the earth.

* * * * *